US007997004B1

(12) United States Patent
Adrian

(10) Patent No.: US 7,997,004 B1
(45) Date of Patent: Aug. 16, 2011

(54) PORTABLE AIR HEATING SYSTEM

(75) Inventor: Trevor Adrian, Park City, UT (US)

(73) Assignee: Taps, LLC, Park City, UT (US)

( * ) Notice: Subject to any disclaimer, the term of this patent is extended or adjusted under 35 U.S.C. 154(b) by 100 days.

(21) Appl. No.: 10/960,427

(22) Filed: Oct. 6, 2004

Related U.S. Application Data

(63) Continuation-in-part of application No. 10/215,918, filed on Aug. 9, 2002, now Pat. No. 6,941,677.

(60) Provisional application No. 60/311,647, filed on Aug. 10, 2001, provisional application No. 60/509,226, filed on Oct. 6, 2003.

(51) Int. Cl.
*F26B 19/00* (2006.01)

(52) U.S. Cl. ..... 34/227; 126/110 B; 126/116 B; 126/109

(58) Field of Classification Search ..... 34/218, 34/227, 104, 202; 126/110 B, 110 D, 116 R, 126/116 B, 109; 165/64, 66, 126, 157
See application file for complete search history.

(56) References Cited

U.S. PATENT DOCUMENTS 2,463,090 A * 3/1949 Dixon et al. ..... 62/261
2,716,975 A 9/1955 Johnston
2,811,962 A 11/1957 Pelsue et al.
3,036,382 A 5/1962 Shotton, Jr.
3,435,817 A 4/1969 Ott
3,451,663 A 6/1969 Hille
3,766,844 A * 10/1973 Donnelly et al. ..... 454/238
3,815,572 A 6/1974 Wolfe
3,916,870 A 11/1975 Beavers
4,000,749 A 1/1977 Busco
4,111,183 A * 9/1978 Haberthier ..... 126/629
4,268,248 A 5/1981 Wilbur et al.
4,883,512 A 11/1989 Griffis
5,048,753 A * 9/1991 Kellie ..... 237/12.3 C
5,121,739 A 6/1992 Barker
5,331,991 A 7/1994 Nilsson
5,443,624 A * 8/1995 Claesson ..... 95/113
6,941,677 B2 9/2005 Adrian

* cited by examiner

*Primary Examiner* — Jiping Lu
(74) *Attorney, Agent, or Firm* — Workman Nydegger

(57) ABSTRACT

A portable air heating system provides a stream of heated air. The heating system generally has an air transfer assembly for providing a flow of air through the system, a fuel burner assembly having one or more burners for providing heat by combustion, and a heat transfer housing for safely transferring the heat produced by the fuel burner assembly to the air flowing through the transfer assembly. The burner assembly has burners with inlets having generally horizontal axes that are disposed from one or more heat transfer tubes mounted in the heat transfer housing. The burner assembly and the heat transfer assembly are positioned outside the area being heated so that the exhaust gases are completely isolated from the air heated by the system, thereby virtually eliminating the likelihood of asphyxiation by the exhaust gases from the burner.

5 Claims, 14 Drawing Sheets

24B
24A
24B
24

24
22B

22

24A
26C
26D
28
26B
22A
26A
26E
26

PORTABLE AIR HEATING SYSTEM

CROSS-REFERENCE TO RELATED APPLICATIONS

This a continuation-in-part application of U.S. patent application Ser. No. 10/215,918, filed Aug. 9, 2002, now U.S. Pat. No. 6,941,677 entitled "Portable Air Heating System", which claims priority to and the benefit of U.S. Provisional Patent Application Ser. No. 60/311,647, filed Aug. 10, 2001, entitled "Portable Air Heating System," and the present application also claims priority to and the benefit of U.S. Provisional Patent Application Ser. No. 60/509,226, filed Oct. 6, 2003, entitled "Portable Air Heating System", the disclosures of which are incorporated herein by this reference.

BACKGROUND OF THE INVENTION

1. The Field of the Invention

The present invention generally relates to heating devices. More particularly, the present invention relates to a portable air heating system for use in remote areas, during emergency circumstances, with constructed shelters and/or where large quantities of heated air are desired.

2. The Relevant Technology

The popularity of outdoor recreation in the United States has grown tremendously in recent years. An ever increasing number of outdoor activities have become more accessible to a greater number of people, resulting in a greater proportion of the general population spending more time in less developed and remote areas of the country. Examples of such recreational activities include hiking, biking, camping, hunting, rock climbing, and mountain climbing.

This increased interest and participation in outdoor recreation has increased the demand for products that provide some of the comforts of modern living. For instance, portable tents of many shapes and sizes have been manufactured to provide privacy and shelter during camping and overnight excursions to remote outdoor areas. Additionally, products such as folding chairs, compact cooking apparatus, backpacks, and portable food storage devices, such as coolers, enable persons to enjoy activities in remote areas while still enjoying some of the necessities or comforts of modern life.

These modern comforts are useful for other individuals that work in adverse weather conditions. Many occupations require people and animals to work in adverse weather conditions to protect the lives of people, clean-up hazardous materials, or complete construction projects on time. As with recreational activities, portable tents of many shapes and sizes have been manufactured to provide privacy and shelter for these workers.

A common concern for persons spending time in the outdoors relates to keeping warm. Without the benefit of temperature-regulated buildings or structures, a person in a remote area or otherwise exposed to the elements is often subject to extreme temperature variations. For example, mountainous areas are a popular destination for campers, hikers, bikers, climbers, and hunters. Yet, because of their high elevation, these areas often experience much lower temperatures than are comfortable, especially at night. In the event that campers, hikers, bikers, climbers, and hunters become injured or lost, rescue personnel must combat the extreme temperatures to extricate the recreational enthusiast. Similarly, police officers, medical personnel, fire service personnel, hazardous material clean-up crews, and military personnel continue working during all weather conditions.

Portable heat sources are often used to help protect oneself from the low temperatures frequently encountered while in the outdoors, whether during recreation or occupational activities. One example of such a portable heat source is a small packet containing substances that, when activated by pressure, produce an exothermic chemical reaction, thereby providing heat for a limited amount of time. Once activated, the packet can be placed close to the body part desired to be warmed, such as the hands, feet, or face, thereby providing relief from the cold. Despite their convenience, such heat packets are of limited value because of their small size and limited output of heat. Also, these packets cannot heat an enclosed space, such as the interior of a structure like a tent, tent trailer, camper, or camp trailer.

Portable direct air combustion heaters have also been utilized for purposes of providing heat in the outdoors where other sources of heat, such as electricity, are unavailable. These combustion heaters burn a fuel, such as gasoline or propane, to produce relatively large quantities of heat. These direct air combustion heaters are commonly used in the outdoors to heat enclosed areas, such as the interior of a tent, tent trailer, camper, or camp trailer. Notwithstanding their ability to heat an enclosed interior space, direct air combustion heaters can pose serious safety hazards. In particular, these heaters burn a mixture of fuel and air in a combustion reaction to produce heat. This reaction also creates a byproduct of potentially dangerous gases, such as carbon monoxide and carbon dioxide. These exhaust gases are potentially very dangerous and in some cases deadly because they may replace the oxygen within an enclosed environment, such as a tent, tent trailer, camper, or camp trailer, and potentially asphyxiate or at least make the persons therein ill. Much care, therefore, must be taken with such heaters to provide proper ventilation to avoid illness and/or asphyxiation by the exhaust gases. Additionally, placing direct air combustion heaters inside the tent or camp trailer poses a fire hazard due to the flammable materials often stored inside such structures, or from which such structures are manufactured.

BRIEF SUMMARY OF THE INVENTION

In light of the above-described problems associated with conventional portable heaters, a need exists for a reliable and highly portable heat producing system that efficiently and safely provides relatively large quantities of heated air to persons and structures in remote areas. Moreover, a need exists for a portable heater that is easy to assemble and disassemble, and can produce heat safely without creating elevated levels of potentially dangerous and even deadly exhaust gases, including carbon monoxide, within an enclosed space, such as a tent, tent trailer, camper, camp trailer, shelters, or other structure to be heated.

In accordance with the general principles of the present invention, as embodied and broadly described herein, the foregoing needs can be met by a portable air heating system. The portable air heating system can be also compact and portable, thereby allowing it to be easily transported. Due to its simple design, the system can be also easily set up for use in a minimum amount of time. The portable air heating system can be particularly useful in remote areas where access to more conventional methods for providing heat are unavailable, though the heating system may also be utilized in a variety of other locations as well. The air heated by the heating system can be isolated from combustion-produced exhaust gases, allowing the air within an enclosed space, such as a tent, to be heated safely.

One portion of a portable air heating system can be an air transfer assembly that both draws air into the system and expels air out of the system. The air transfer an assembly can include an air intake conduit and air outlet conduit, both of which have one end connected to a heat transfer housing. A motorized fan disposed within the air intake conduit can draw air into the air intake conduit through the free end, and expel the air through passages defined in the heat transfer housing and through the air outlet conduit. The motorized fan can be powered by an electrical source, such as a battery. The air transfer system can allow the user to draw air from either inside or outside of the location desired to be heated. For example, the air transfer assembly may be used to bring fresh outside air into a tent, or it may be used to re-circulate and/or reheat the air already inside the tent. The air transfer assembly can also be used to direct the heated air into the tent or other structure.

In one exemplary portable air heating system, the system can include a heat transfer housing which can include one or more exterior walls defining the perimeter of the housing, and a plurality of passages or heat transfer tubes extending from one side of the housing to the other side of the housing. The heat transfer tubes, which transport the air to be heated through the heat transfer housing, can isolate the air to be heated from the harmful exhaust gases produced by burning fuel during operation of the air heating system. Additionally, the heat transfer tubes may be constructed of copper or other conductive material, and can be arranged in a pattern that maximizes their exposure to heat produced by a burner during operation of the air heating system. Thus, the heat transfer tubes can be configured to absorb the heat produced by the burner and transfer it to the air flowing through the heat transfer tubes. The heat transfer housing can include one or more heat deflectors that assist in directing the heat produced by the burner toward the heat transfer tubes. The heat deflectors can also increase the safety of the system by reflecting the heat away from the exterior walls of the heat transfer housing so that the walls are not the primary point of heat contact.

The portable air heating system can also include a fuel burner assembly. The fuel burner assembly can include one or more fuel burners, located directly below the heat transfer tubes and at least partially within the exterior walls of the heat transfer housing, a fuel supply tube connected to the burner (s), and a connector for connecting the fuel supply tube to a fuel source, such as one or more liquid propane tanks. The connector can also include a valve for controlling the flow of fuel to the one or more burners.

To operate one exemplary portable air heating system, the system can be first securely placed on the ground or other stable location outside the structure to be heated, such as a tent. In one configuration, this can include moving a support structure upon which is mounted the heat transfer assembly, the fuel burner assembly, and optionally the fuel source to a location near the tent. Following placing the support structure, the free end of the air intake conduit can be placed outside the structure to be heated, where it has access to fresh, ambient air. Alternatively, the free end of the air intake conduit may be positioned inside the structure to be heated to re-circulate air from inside the structure through the heat transfer housing circulate. Re-circulating the air inside the structure allows the structure to be heated more quickly and to a higher temperature. The free end of the air outlet conduit can be disposed within the structure to supply heated air to the structure.

Next, the fuel supplied to the burner(s) through the fuel supply tube can be ignited to produce an exothermic combustive reaction within the heat transfer housing. Turning on the motorized fan produces a flow of air through the air intake conduit, the heat transfer tubes, and the air outlet conduit. The burning fuel heats the heat transfer tubes, which are thermally conductive so as to absorb a significant portion of the heat produced by the burner. This heat warms the air passing through the heat transfer tubes. The heated air then can be directed through the outlet conduit to exit the system and enter the structure to be heated. In this way, the interior of a tent, a portable structure, a fixed structure, a vehicle, or any other structure to which heated air can be directed or re-circulated can be heated.

The air flowing through the air transfer assembly does not mix with the exhaust gases. That is, the heated air at no point comes into contact with the potentially dangerous gases, such as carbon monoxide, produced as a byproduct of the fuel combustion. These exhaust gases, which are produced in the heat transfer housing located exterior to the structure, pass harmlessly out of the heat transfer housing and into the atmosphere during operation of the heating system. Thus, the tent or other structure can be safely isolated from the harmful exhaust gases during safe heating of the interior of the structure. This results in a comfortable and safe environment for persons within the tent or other structure.

The portable heating system may also be employed as a body warmer by directing the flow of heated air exiting the air outlet conduit over one's body. In an alternate configuration, a portion of the heat transfer housing may be used as a heating surface for warming food or even warming or drying clothing. In still another configuration, the flow of heated air exiting air heating system can warm equipment, chemicals, temperature sensitive instruments, or other devices so that they remain within a desired temperature range.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE EXEMPLARY EMBODIMENTS

Reference will now be made to the figures where various structures will be provided with reference number designations. It is understood that the drawings are diagrammatic and schematic representations of possible embodiments of the invention, and are not intended to limit the scope of the present invention nor are they necessarily drawn to scale. Further, one skilled in the art will appreciate that terms such as top, bottom, upper, and lower as used herein are merely words used to describe the accompanying figures, and are not meant to limit the scope of the present invention in any way.

FIGS. 1-9 depict various elements of one exemplary self-contained, portable air heating system. Advantageously, the inventive portable heating system provides a reliable source of heated air to an enclosed structure, such as a tent or camp trailer, while eliminating the introduction of potentially dangerous exhaust gases, such as carbon monoxide, into the enclosed structure. In addition, the air heating system is portable and simple to use, which is particularly important when the user is traveling to remote areas.

Figure 1:
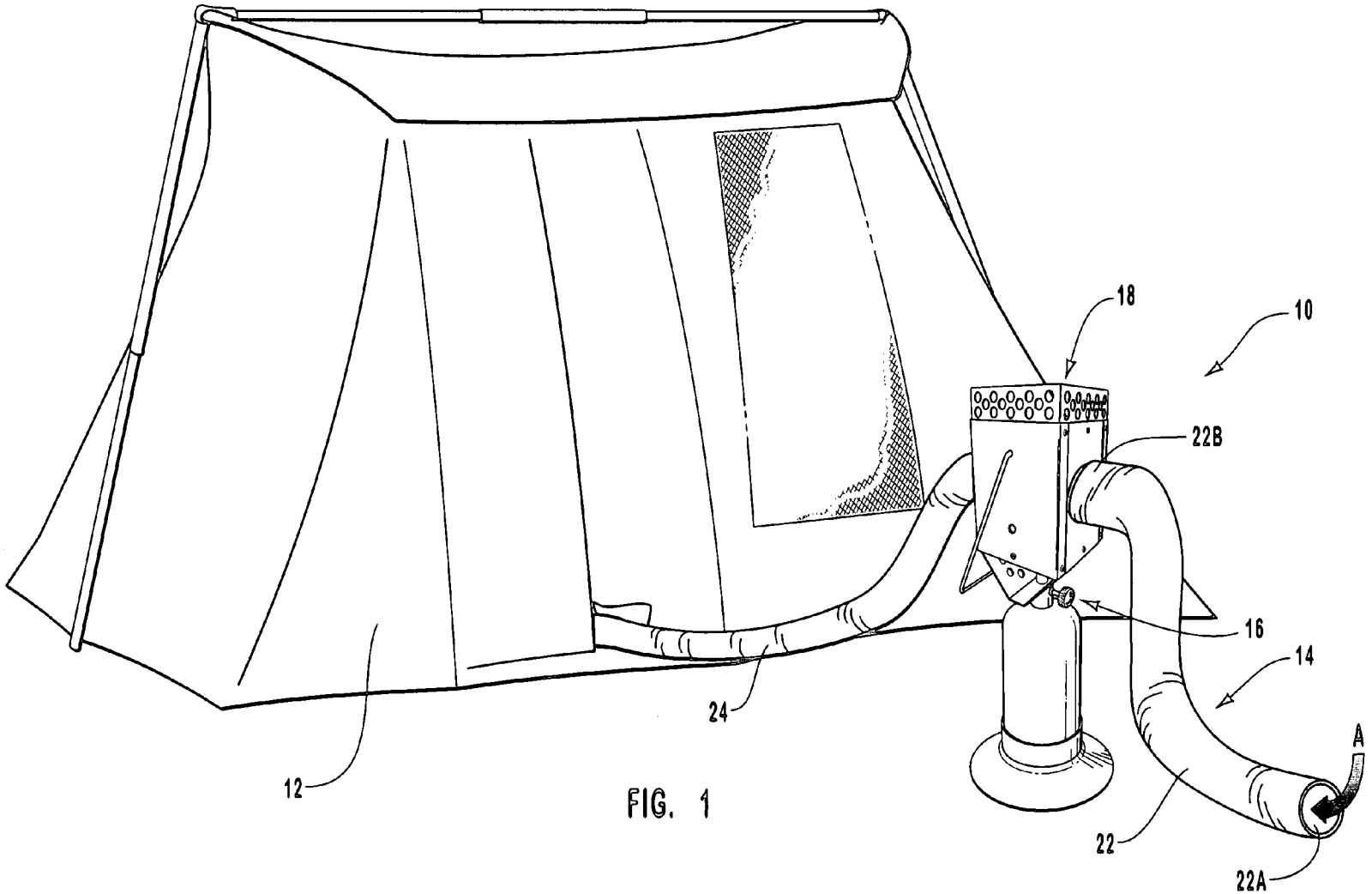
FIG. 1 is a perspective view of one embodiment of a portable air heating system and illustrates one example of using the heating system with a tent structure.

FIG. 1 illustrates one embodiment of a portable air heating system 10 used for heating an enclosed structure 12, such as a tent, tent trailer, camper or camper trailer, shelters, storage facilities, vehicles, or other structures used by individuals, animals, or equipment, whether or not such structures are fixed or movable. FIG. 1 depicts one possible arrangement of portable air heating system 10 being used to heat the interior of tent 12. The discussion herein refers to use of portable air heating system 10 with a tent. It will be appreciated by one skilled in the art that this discussion and description of use is equally applicable to other types of enclosed structures, including but not limited to tent trailers, campers, camper trailers, shelters, storage facilities, vehicles, or other structures used by individuals, animals, or equipment, whether or not such structures are fixed or movable.

As can be seen from FIG. 1, portable air heating system 10 can be placed near, but not in, tent 12. Air heating system 10 can be configured such that the air heated by air heating system 10 and blown into tent 12 is isolated from the combustion portion of air heating system 10 producing the heat. In particular, the air heated by air heating system 10 is always kept isolated from the exhaust gases, which are vented by air heating system 10 into the atmosphere exterior to tent 12. Thus, air heating system 10 safely heats the interior of tent 12 because it does not introduce harmful exhaust gases, including but not limited to carbon monoxide, into tent 12. In addition to reliably and safely providing heated air to a person or the interior of a structure, air heating system 10 may also simultaneously be used to heat things such as food, drinks, small articles of clothing, etc., by placing such things on top of heating system 10, as will be discussed in further detail later on.

With continued reference to FIG. 1, portable air heating system 10 includes an air transfer assembly 12, a fuel burner assembly 16, and a heat transfer housing 18. During operation of air heating system 10, which is explained in further detail below, the above components operate in unison to provide a safe supply of heated air for use as desired by the user.

In the depicted arrangement of FIG. 1, air transfer assembly 12 directs fresh, ambient air into and through heat transfer housing 18 and into tent 12. In one possible embodiment depicted in FIG. 1, air transfer assembly 12 includes a hollow air intake conduit 22 having open first and second ends 22A and 22B, respectively, and a hollow air outlet conduit 24 having open first and second ends 24A and 24B, respectively shown in FIG. 2. Second ends 22B and 24B of air intake and air outlet conduits 22 and 24, respectively, are removably attached to heat transfer housing 18 to direct a flow of air through heat transfer housing 18. It will be appreciated by one skilled in the art that while FIGS. 3A and 3B depict air outlet conduit 24, the discussion related thereto substantially applies to air intake conduit 22.

Returning to FIG. 1, air intake conduit 22 draws air, such as ambient air, into air heating system 10, and air outlet conduit 24 directs heated air into tent 12. FIG. 1 depicts one possible way of arranging air intake conduit 22 and air outlet conduit 24. As depicted, first end 22A of air intake conduit 22 is positioned outside of tent 12 and draws in ambient air as illustrated by arrow A. Alternatively, it is contemplated herein that in some cases it might be desired to utilize the configuration depicted in FIG. 8, where first end 22A of air intake conduit 22 draws air from the inside of tent or structure 12 into heat transfer housing 100. This heated air can then be blown out air outlet conduit 24 back into tent 12. The effect of this arrangement is recirculating and reheating the air within tent 12.

Figure 2:
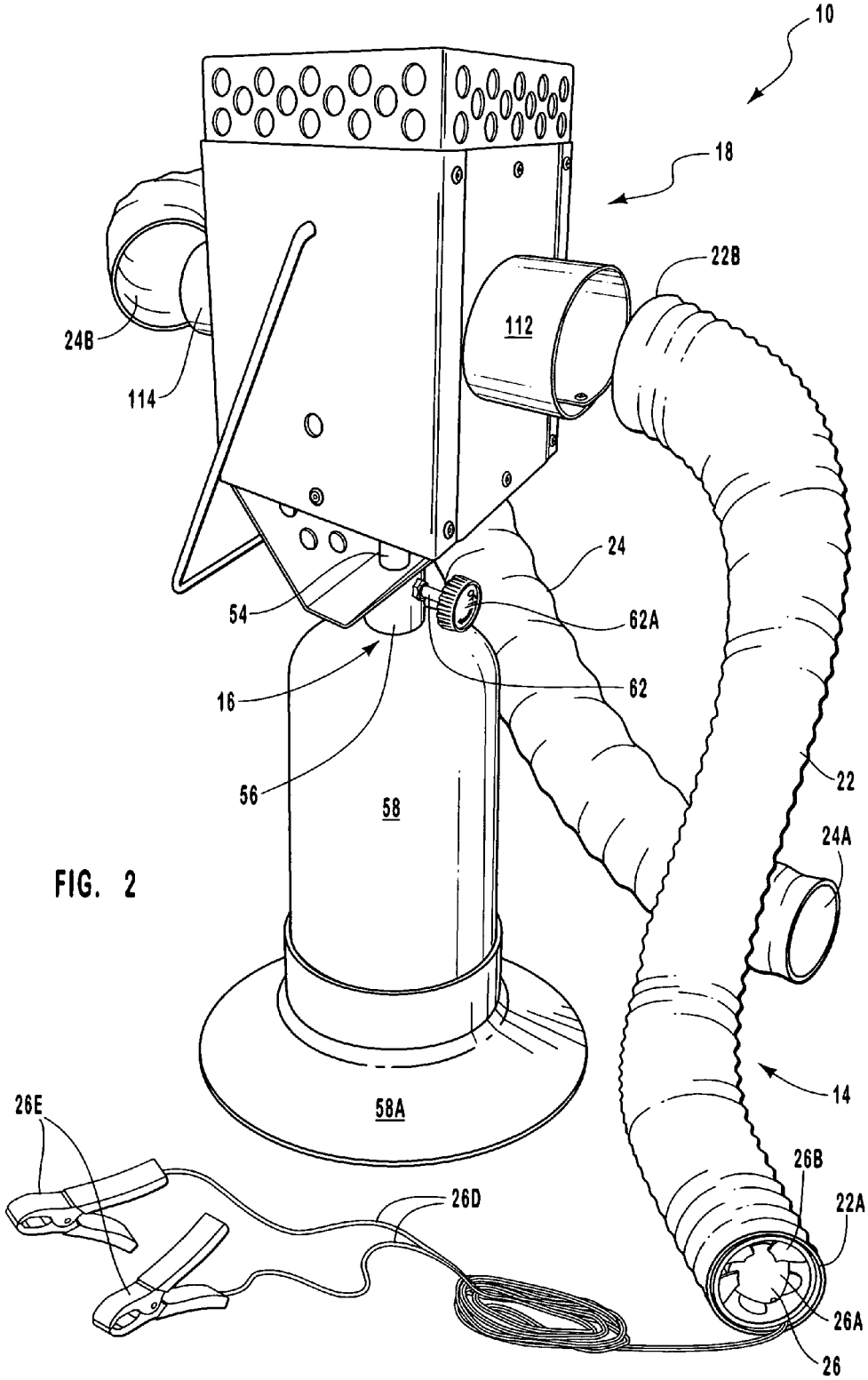
FIG. 2 is a perspective, partially exploded view of the portable air heating system shown in FIG. 1.
Figures 3A, 3B, 3C:
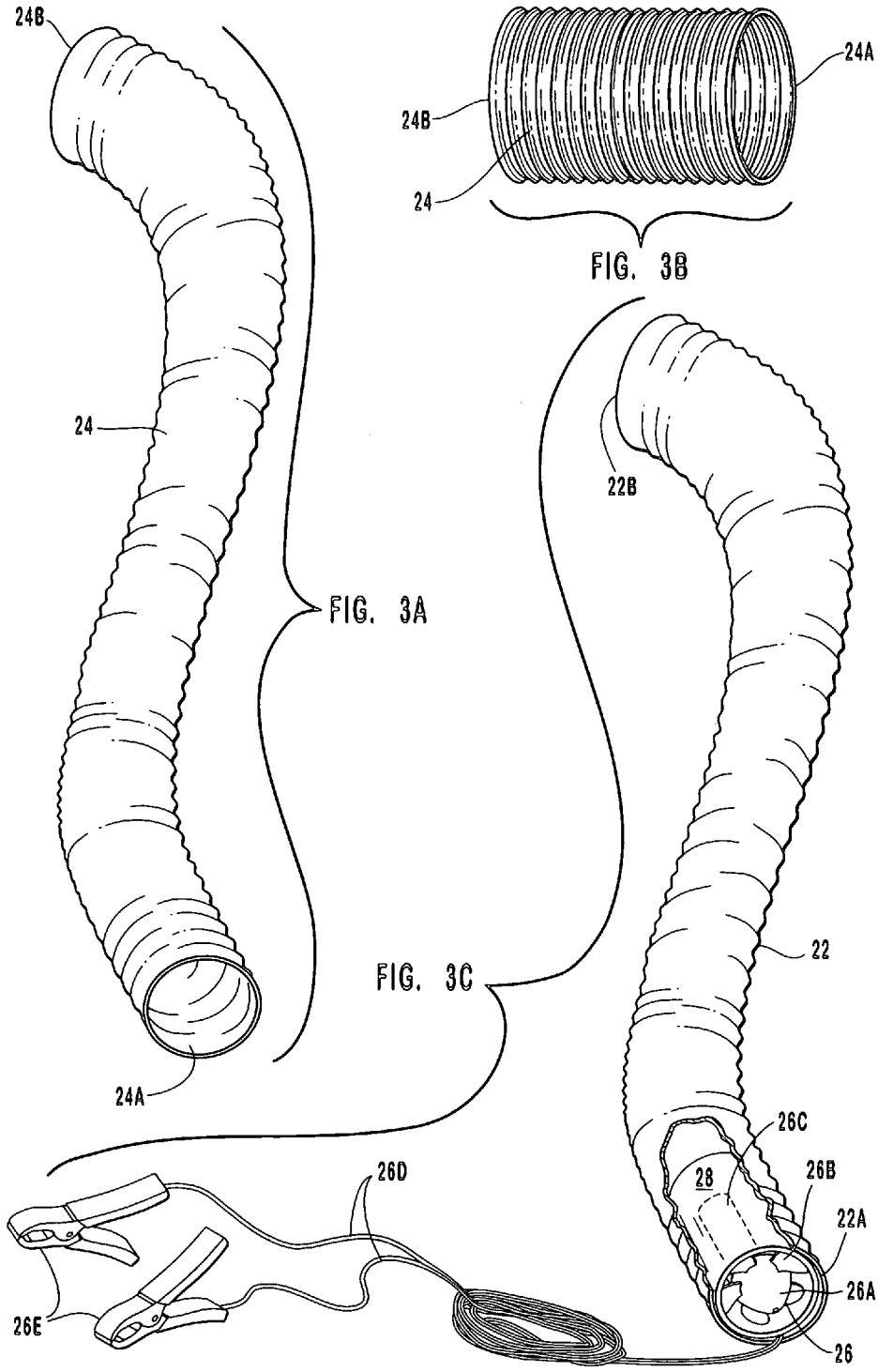
FIG. 3A is a perspective-view of one embodiment of an air outlet conduit of the portable air heating system shown in FIG. 2 in an expanded position.
FIG. 3B is a perspective view of the air outlet conduit shown in FIG. 3A illustrated in a collapsed position.
FIG. 3C is a perspective break away view of one embodiment of an air intake conduit of the portable air heating system shown in FIG. 2, illustrating the air intake conduit in an expanded position.

As depicted in FIGS. 2, 3A, 3B and 3C, air intake and air outlet conduits 22 and 24, respectively, are preferably flexible to offer maximum versatility in positioning air intake and outlet conduits 22 and 24, respectively, in the desired locations relative to tent 12 and heat transfer housing 18. In one embodiment, air intake conduit 22, and particularly air outlet conduit 24, may optionally have a heat reflective inner surface to help retain the heat of the air therein. Additionally, air intake and air outlet conduits 22 and 24, respectively, may also optionally include a helically wound metallic wire to provide resilient support for the conduits. Advantageously, conduits constructed in this manner are strong enough to maintain their substantially cylindrical shape while under some stress, yet are lightweight and collapsible, as depicted in FIG. 3B, for easy storage and transport. Further, air intake conduit 22 and air outlet conduit 24 are preferably expandable to any suitable lengths necessary to enable portable air heating system 10 to function properly and safely. For example, in one embodiment, air intake and air outlet conduits 22 and 24, respectively, are each approximately two to four feet long when extended to their preferred operating length, but the conduits may have any suitable length depending upon the intended use of air heating system 10. It will be appreciated by those skilled in the art that various other lengths of air intake conduit 22 and air outlet conduit 24 are capable of performing the function thereof. In addition, it will also be appreciated by one skilled in the art, that while one embodiment of air intake conduit 22 and air outlet conduit 24 depicted in FIGS. 2, 3A and 3C, have the same length, this is not required. Depending on the particular use for portable air heating system 10, it is contemplated that a particular configuration of air heating system 10, could utilize air intake conduit 22 and air outlet conduit 24 each having a different length. It will also be appreciated that while air intake and outlet conduits 22 and 24, respectively, are depicted as having a substantially cylindrical cross-section, they could have various other configurations and perform the function thereof.

As can be seen in FIG. 3C, in one embodiment air intake conduit 22 has a motorized fan 26 at least partially disposed within its inner volume. It will be appreciated that various types of motorized fans could be utilized in this device. In one possible embodiment illustrated in FIGS. 2 and 3C, motorized fan 26 directs air into the air intake conduit 22 and through air transfer assembly 20. In one embodiment, motorized fan 26 includes an impeller 26A having a plurality of blades 26B and a motor 26C (FIG. 3C). In one embodiment of motorized fan 26, illustrated in FIG. 3C, blades 26B are angled relative to the axis of rotation. It will be appreciated that blades 26B could have various other angular positions relative to the axis of rotation, including being perpendicular thereto. Motorized fan 26 can be configured to include a power source. It will be appreciated that various types of power sources could be utilized for motorized fan 26, such as batteries or adaptors to connect motorized fan 26 to a separate power source such as a car battery, generator, or other power source.

In one possible embodiment, illustrated in FIGS. 2 and 3C, motorized fan 26 can include two electrical cable leads 26D in electrical communication with motor 26C. Electrical cable leads 26D may have any suitable length, such as by way of example and not limitation, approximately 12 feet, and are fitted with clamps 26E, allowing motor 26C of motorized fan 26 to be electrically connected to a car battery or other power source. Motorized fan 26 may also include an on/off switch (not shown) to control the function of the fan during operation of portable air heating system 10.

In another embodiment, electrical cable leads 26D may be electrically connected to a 12 volt cigarette plug configured to cooperate with a car, boat, camper and the like. Alternatively, electrical cable leads 26D may be attached to a rechargeable battery or other suitable power source disposed near heating system 10 for added convenience and portability. Motorized fan 26, in one configuration, can be structurally supported by and housed in a sleeve 28 comprising thermoplastic or similar material that, in turn, can be fixedly disposed within air intake conduit 22 near first end 22A thereof by conventional fastening devices (not shown), such as a coupler. It will be appreciated that although sleeve 28 depicted in FIG. 3C as being cylindrical, sleeve 28 could have various other configurations including square, oval, elliptical, rectangular, polygonal, or various combinations thereof as long as sleeve 28 is configured to be attached to air intake conduit 22.

It will also be appreciated that while motorized fan 26 is depicted as disposed within air intake conduit 22, motorized fan 26 could instead be attached to first end 22A of air intake conduit 22 or attached to an exterior of air intake conduit 22. Various other arrangements are capable of carrying out the intended function thereof. One skilled in the art will appreciate that motorized fan 26 may be disposed in other locations in portable air heating system 10 while still preserving its functionality. Likewise, motorized fan 26 may differ in size and configuration from that explicitly described herein. For example, a fan powered by solar energy could be disposed in air outlet conduit 24 in order to direct air through air heating system 10.

Figure 4:
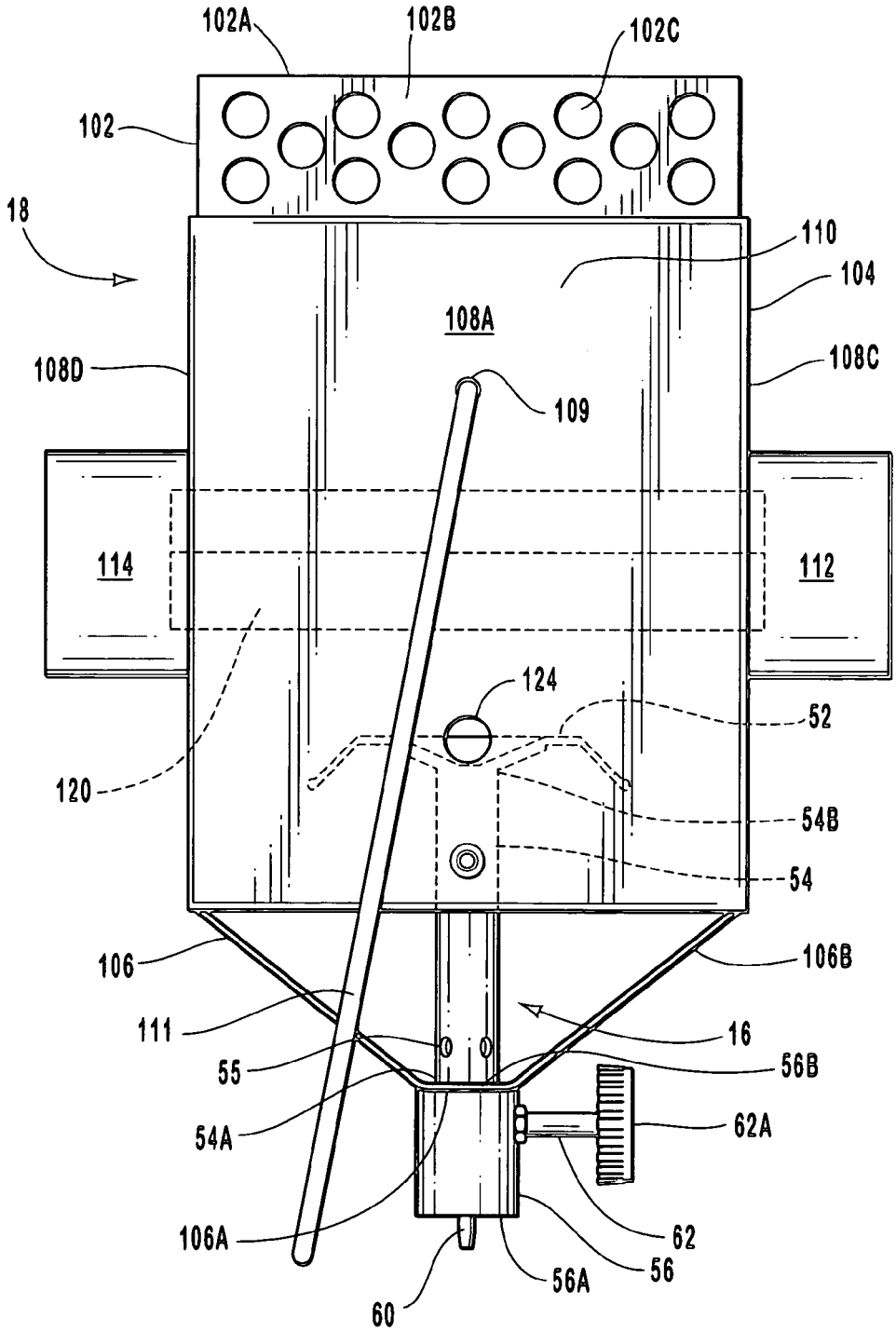
FIG. 4 is a front view of one embodiment of a portable air heating system shown in FIG. 1 with the fuel source, and the air intake and outlet conduits removed.

As depicted in FIG. 4, air heating system 10 includes fuel burner assembly 16, which combusts fuel to create heat in heat transfer housing 100. Fuel burner assembly 16 includes a burner 52, a fuel supply tube 54, and a connector 56 that contains valve 62 therein. As illustrated in FIG. 2, connector 56 connects fuel burner assembly 16 to a fuel source 58, such as a conventional pressurized propane canister. Alternatively, other sizes and types of fuel sources may be utilized while still preserving the functionality of portable air heating system 10. For example, burner assembly 16 may be connected to a large five-gallon pressurized liquid propane tank, of the type commonly used with camp trailers, barbeques and the like. Further, fuel burner assembly 16 can include multiple burners 52 that either individually connect to separate fuel sources or collectively connect to a single fuel source or multiple connected fuel sources.

More specifically, returning to FIG. 4, connector 56 connects fuel source 58 (see FIG. 2) to fuel supply tube 54. A needle 60 extends from a first end 56A of connector 56 into an outlet of fuel source 58 (not shown) to enable fuel from fuel source 58 to flow into connector 56. Valve 62 has a control knob 62A attached thereto and can be disposed in connector 56 to control the flow of fuel through connector 56. Second end 56B of connector 56 can attach to first end 54A of fuel supply tube 54. Fuel supply tube 54 includes a plurality of vent holes 55 to allow air to be mixed with the fuel. Burner 52 can attach to second end 54B of fuel supply tube 54 and include a plurality of openings (not shown) to release the fuel-air mixture where the flame will occur.

Figure 5:
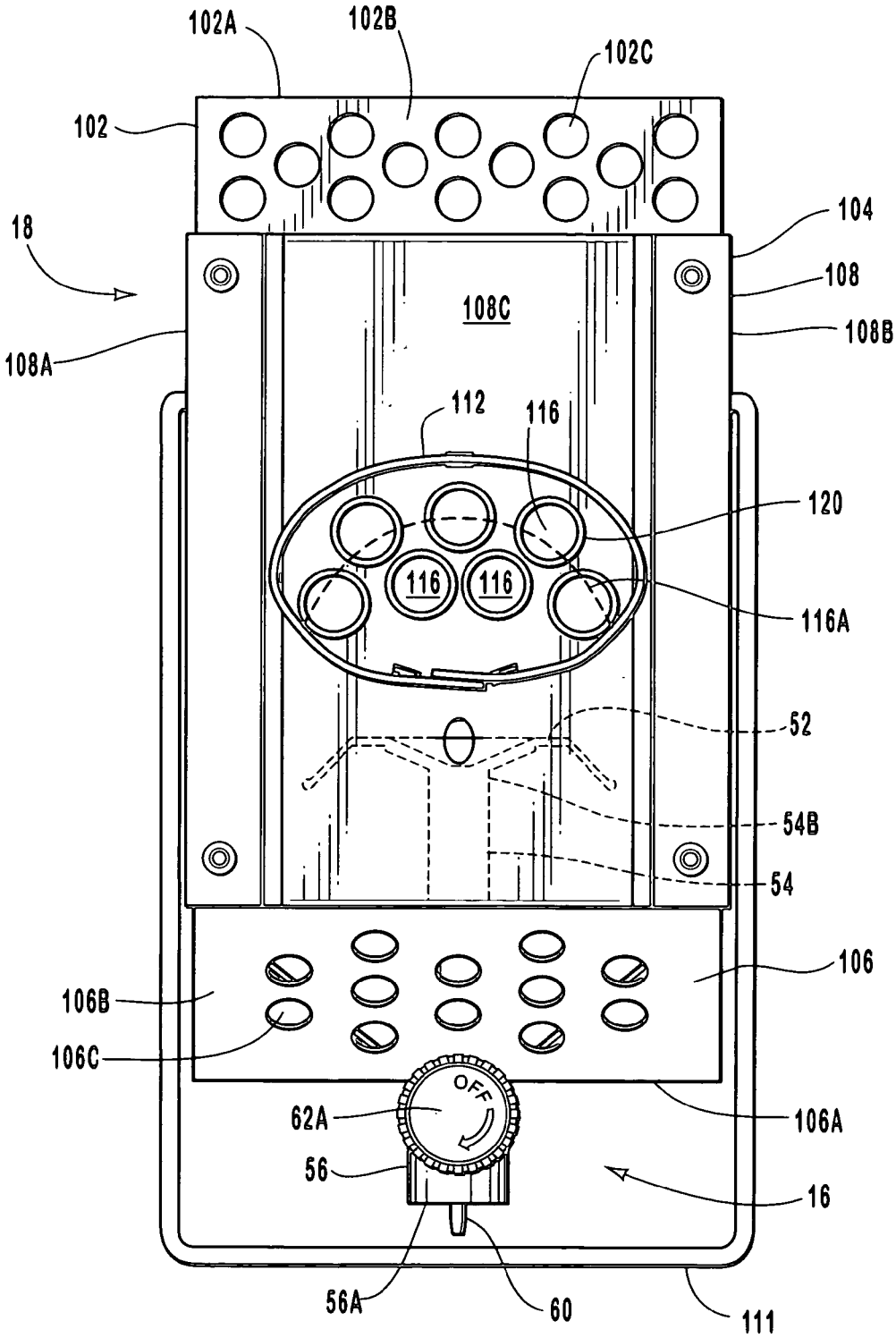
FIG. 5 is a side view of one embodiment of a portable air heating system shown in FIG. 4.

Reference now is made to FIGS. 4 and 5, which illustrate various features of heat transfer housing 18. Heat transfer housing 18 provides an enclosure in which heat produced by combustion of the fuel-air mixture is transferred to air flowing through heat transfer housing 18. Heat transfer housing 18 also directs the heat produced by the combustion towards one or more heat transfer tubes 120, which will be discussed in further detail below. Heat transfer housing 18 is preferably composed of a metallic material, such as steel, but one skilled in the art will appreciate that heat transfer housing 18 could be formed from other materials as well.

Heat transfer housing 18 can include a first end portion 102, a middle portion 104, and a second end portion 106. First end portion 102 may be integral with middle portion 104 or fixedly attached to middle portion 104 using any one of several attachment or fastening methods well known in the art, such as welding or mechanical fasteners. First end portion 102 includes a substantially planar top surface 102A and sides 102B. Top surface 102A, when heated by burner 52 during the operation of portable air heating system 10, may serve as a heating surface for warming things such as food, drinks, articles of clothing, etc. Sides 102B of first end portion 102 each include a plurality of openings 102C for venting exhaust gases from heat transfer housing 18. In one embodiment, sides 102B of first end portion 102 have approximately 14 openings 102C formed therein for venting combustion gases from heat transfer housing 100. It will be appreciated that various other numbers of openings could be formed in sides 102B of first end portion 102 to perform the function thereof. In addition, it will also be appreciated by one skilled in the art that openings 102C formed in sides 102B could have various other configurations other than round. Openings 102C could be square, rectangular, triangular, elliptical, octagonal, oval, polygonal, or numerous other shapes or combinations thereof and still perform the function thereof. It will also be appreciated that openings 102C could also be formed in top surface 102A of first end portion 102.

In one possible embodiment, depicted in FIGS. 4 and 5, heat transfer housing 18 has a hollow, box-like configuration. It will be appreciated that heat transfer housing 18 may have various other configurations, including cylindrical, oval, elliptical, polygonal, or the like.

Second end portion 106 of heat transfer housing 18 may also be integral to middle portion 104 or may be fixedly attached to middle portion 104 using any one of several attachment or fastening methods well known in the art, such as welding or mechanical fasteners. As depicted in FIG. 4, second end portion 106 of heat transfer housing 100 includes a substantially planar segment 106A supported a distance away from middle portion 104 of heat transfer housing 18 by two segments 106B that are divergingly angled with respect to one another. It will be appreciated that segments 106B in second end portion 106 could have different configurations, such as being flat, and perform the function thereof. It will be appreciated by one skilled in the art that second end portion 106 could have various other configurations and perform the function thereof. By way of example and not limitation, second end portion 106 could be an open box-like structure that is either formed of one sheet of material or multiple sheets attached together. Similarly, second end portion 106 could have the configuration of half a sphere with a generally flat spot at the center of the spherical surface remote from middle portion 104. It will be appreciated that numerous other configurations of second end portion 106 may be utilized to perform the function thereof.

In one embodiment depicted in FIG. 5, each angled segment 106B is attached at one end to substantially planar segment 106A and at the other end to middle portion 104. Each angled segment 106B includes a plurality of apertures 106C similar in size to those disposed on sides 102B of first end portion 102 to allow air to enter heat transfer housing 18. In one embodiment, the areas adjacent to and between the outer edges of angled segments 106B are open to allow additional air to enter heat transfer housing 18.

It will be appreciated that various other numbers of apertures 106C could be formed in segments 106B of second end portion 106 to perform the function thereof. In addition, it will also be appreciated by one skilled in the art that apertures 106C formed in segments 106B could have various other configurations than merely being round. These apertures 106C could be square, rectangular, triangular, elliptical, octagonal, oval, polygonal, or numerous other shapes or combinations thereof and still perform the function thereof.

Returning to FIG. 4, second end portion 106 of heat transfer housing 18 is connected to and structurally supported by fuel burner assembly 16. In particular, one end of fuel supply tube 54 can be inserted through a hole (not shown) in planar segment 106A of second end portion 106 such that planar segment 106A of second end portion 106 of heat transfer housing 18 can rest on second end 56B of connector 56. In this manner, connector 56 of fuel burner assembly 16 supports second end portion 106, which in turn supports the other components of heat transfer housing 18. One skilled in the art will appreciate that the heat transfer housing 100 and the fuel burner assembly 16 could also be connected in various other ways and by other suitable means.

Figure 6:
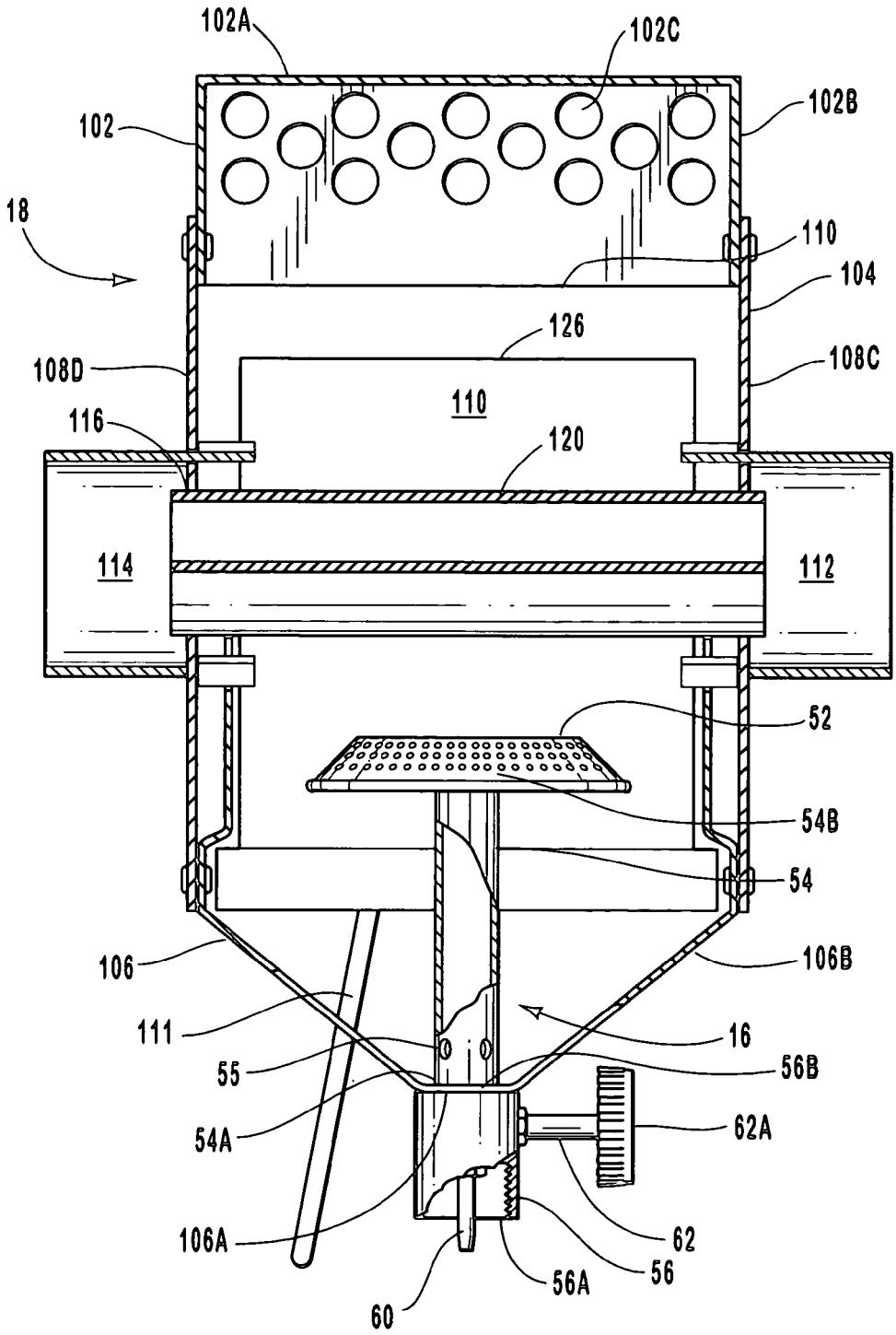
FIG. 6 is a cross sectional front view of one embodiment of a heat transfer housing and one embodiment of a burner assembly from the structure shown in FIG. 4.
Figure 7:
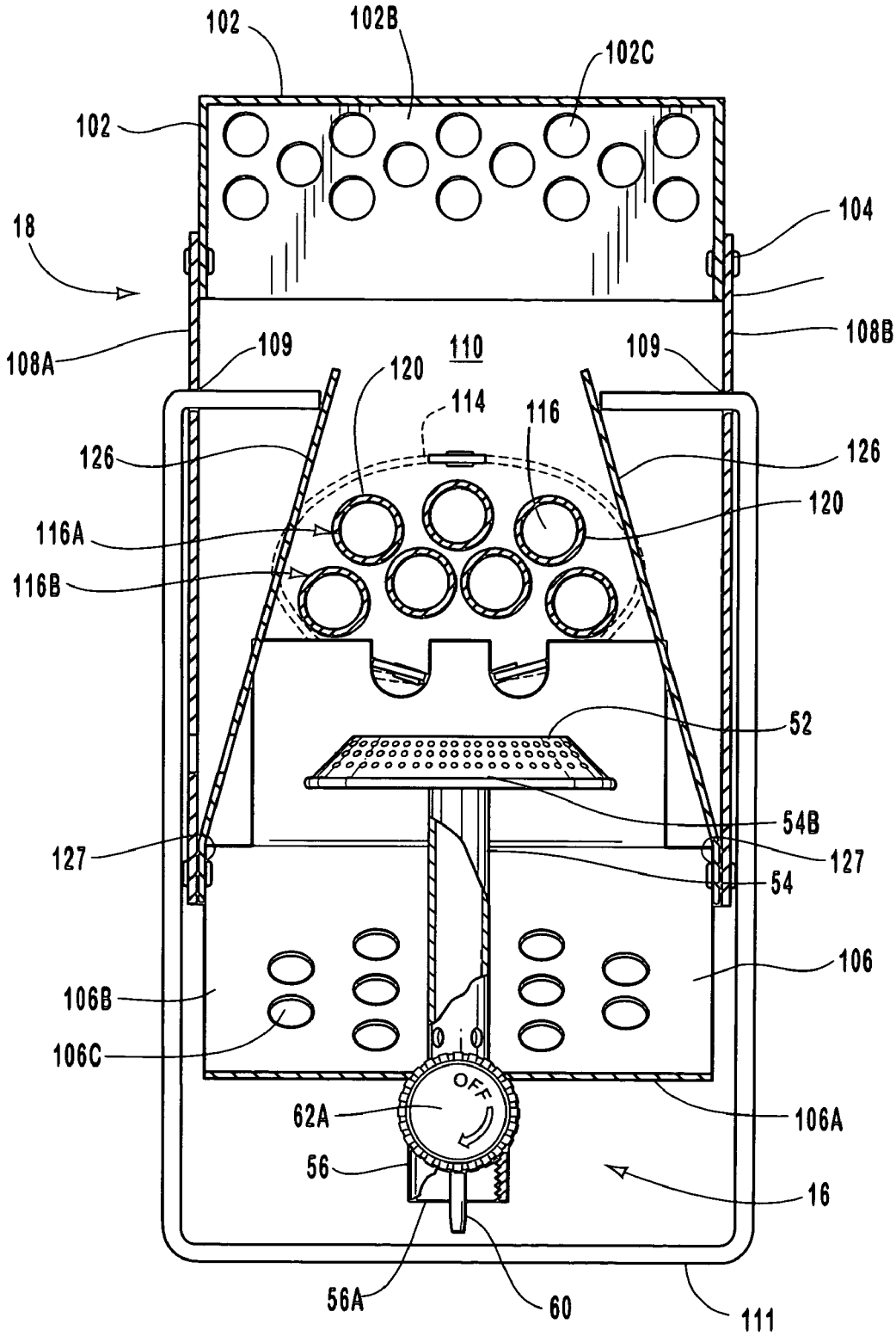
FIG. 7 is a cross sectional side view of the heat transfer housing and burner assembly shown in FIG. 6.

As illustrated in FIGS. 4-7, middle portion 104 of heat transfer housing 18 includes a housing portion 108 with a front side 108A, a back side 108B, a right side 108C, and a left side 108D. Sides 108A-108D together define an interior enclosure 110 for burning the fuel and transferring the heat to the air flowing through air transfer assembly 20. As depicted in FIGS. 4 and 7, middle portion 104 of heat transfer housing 18 has apertures 109 disposed on both the front side 108A and back side 108B configured to receive the ends of a handle 111. It will be appreciated that various numbers and configurations of apertures 109 can be used to perform the same function as long as they are configured to cooperate with handle 111. Optionally, heat transfer housing 100 need not include apertures 109 and need not include handle 111.

Referring to FIGS. 4, 5, and 6, middle portion 104 also includes an intake sleeve 112 for receiving second end 22B of air intake conduit 22 (see FIG. 2). Intake sleeve 112 is attached to right side 108C of the housing portion 108. Correspondingly, as illustrated in FIGS. 4 and 6, middle portion 104 also includes an outlet sleeve 114 attached to left side 108D of housing portion 108 for receiving second end 24B of air outlet conduit 24 (see FIG. 2). As best shown in FIGS. 5 and 6, sleeves 112 and 114 comprise hollow, rounded members composed of steel, aluminum, metal, or other suitable material. In one embodiment, sleeves 112 and 114 are rounded, generally elliptical shaped members. It will be appreciated that various other configurations of sleeves 112 and 114 can be used. By way of example and not limitation, sleeves 112 and 114 may be round, cylindrical, oval, square, rectangular, polygonal, and parabolic, combinations thereof, or other configuration that are complementary to the configuration of air intake conduit 22 and air outlet conduit 24.

Figure 8:
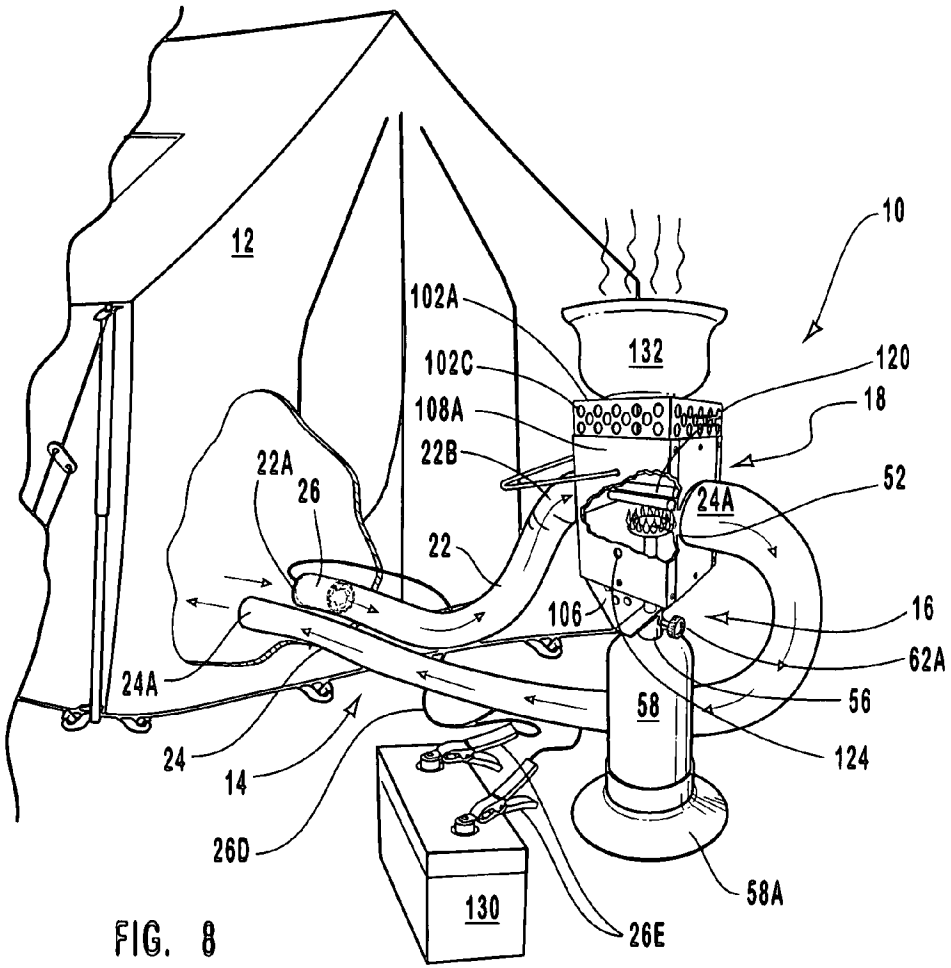
FIG. 8 is a perspective partial cutaway view of one embodiment of a portable air heating system depicting another arrangement for use of the heating system.

Returning to FIGS. 1 and 2, when portable air heating system 10 is operational, second ends 22B and 24B of the air intake and air outlet conduits 22 and 24, respectively, are coupled to intake and outlet sleeves 112 and 114, respectively, in a slip fit arrangement. It is noted that a slight deformation of second ends 22B and 24B of air intake and air outlet conduits 22 and 24, respectively, may be necessary to accomplish the coupling thereof with the intake and outlet sleeves 112 and 114, respectively. Such a deformation is easily accomplished due to the flexible nature of the air intake and air outlet conduits 22 and 24, respectively. It will be appreciated that while in the embodiment of air heating system 10 that is depicted, air intake conduit 22 and intake sleeve 112 and air outlet conduit 24 and outlet sleeve 114, have slightly different configurations (cylindrical as compared to elliptical) these elements could have various other configurations that are designed to cooperate. The shape of air intake and air outlet conduits 22 and 24, respectively and sleeves 112 and 114 are not of particular importance as long as the sleeves cooperate with the conduits. Alternatively, air intake and air outlet conduits 22 and 24, respectively, could be coupled with intake and outlet sleeves 112 and 114, respectively, by other fastening or connecting methods know in the art, including by way of example and not limitation, mechanical fasteners or tie downs. Further, heat transfer housing 18 is configured so that air can flow from sleeve 112 to sleeve 114 as the air is drawn from air intake conduit 122 to air outlet conduit 24. Alternatively, and as shown in FIG. 8, air can flow from sleeve 114 to sleeve 112 as air is drawn from air intake conduit 22 to air outlet conduit 24. Therefore, each conduit 22 and 24 can mount to either sleeve 112 or sleeve 114.

Turning again to FIG. 5, within intake sleeve 112 on left side 108C of housing portion 108, are a plurality of openings 116. Although not shown, there are a corresponding number of similarly configured openings 116 formed on left side 108D of housing portion 108 within outlet sleeve 114. Openings 116 are arranged in pairs on opposing left and right sides 108C and 108D of housing portion 108. In one embodiment, each opening 116 has a diameter of approximately 0.625 inches. It will be appreciated that various other sizes and configurations of openings could be used to perform the function thereof. In addition, in one embodiment depicted in FIG. 5, seven (7) openings are formed on each right and left sides 108C and 108D (not shown), respectively, of housing portion 108, thereby forming seven opposing pairs of openings. It will be appreciated by one skilled in the art, that various other numbers of openings and correspondingly pairs of openings 116 can be used to perform the function thereof.

In one embodiment, openings 116 are arranged on side 108C and, consequently, side 108D (not shown) of housing portion 108 with some of openings 116 being in an arc-like or curved configuration indicated by line 116A. Other openings 116 are positioned around those openings 116. In one embodiment depicted in FIG. 5, by way of example and not limitation, side 108C has five openings 116 in the arc-like arrangement. As shown, in this particular embodiment, two additional openings 116 are placed under the arc-like arrangement. It will be appreciated that various other arrangements of openings 116 are capable of performing the function thereof. With openings 116 arranged in the arc-like configuration, heat transfer tubes disposed there are positioned to maximize heat transfer from the heat generated by fuel burner assembly 16. It will be appreciated that the specific sizes and configurations of the openings 116 as described herein comprise one embodiment of the air heating system 10, but holes having other sizes, shapes and/or collective patterns may also be used depending, for example, upon the intended use of the heating system 10. It will be appreciated that various other numbers and configurations of openings 116 may be used to perform the function thereof. In addition, it will be appreciated that openings 116 may have various dimensions, and that all of openings 116 do not have to be the same size. Likewise, it will be appreciated that various other arrangements of openings 116 may be utilized to perform the function thereof.

Referring now to FIGS. 6 and 7, which depict a cross section of one embodiment of heat transfer housing 18 and one embodiment of fuel burner assembly 16 of the air heating system 10, heating system 10 includes an isolating means for isolating the air being heated from the exhaust gases. The isolating means includes structure providing a conduit between air intake conduit 22 (not shown) to air outlet conduit 24 (not shown). One exemplary structure which performs the function of the isolating means isolates the air from the exhaust gases produced by burner 16 as the air flows from intake conduit 22 to outlet conduit 24. One example of structure which is capable of performing the function of such an isolating means for isolating the air being heated from the exhaust gases can be heat transfer housing 18 which includes housing portion 108 and heat transfer tubes or members 120.

As illustrated, heat transfer tubes 120 extend between each of the pairs of opposing openings 116. Each heat transfer tube 120 absorbs heat emitted by burner 52 during combustion of the fuel, transferring the heat to air flowing through heat transfer tubes 120. In one embodiment, heat transfer tubes 120 are composed of copper, metals, or other conductive material and are configured to connect opposing holes 116 in the side walls 108C and 108D of housing portion 108. It will be appreciated that heat transfer tubes 120 could be composed of other materials that are capable of absorbing the heat emitted by burner 52 and transferring the same to the air flowing through heat transfer tube 120.

In one embodiment, each heat transfer tube 120 is sufficiently long to allow each heat transfer tube 120 to extend from one opening 116 on right side 108C of housing portion 108 to the opposing opening 116 on left side 108D of housing portion 108. In one embodiment, the distance between opposing sides 108C and 108D is approximately 5.2 inches. It will be appreciated that various other lengths of heat transfer tubes 120 may be used as long as each heat transfer tube 120 is configured to cooperate with opposing openings 116, and isolates the air being heated from the harmful exhaust gases. It will be appreciated that although heat transfer tube 120 is illustrated as being a hollow round member, heat transfer tube 120 could have various other shapes or configurations as long as it is hollow. By way of example and not limitation, heat transfer tube 120 could be oval, elliptical, square, rectangular, polygonal, or the like and any combination thereof as long as it is a hollow member.

Another possible embodiment of an isolating means for isolating the air being heated from the exhaust gas is a single tubular member providing a fluid connection from air intake conduit 22 through heat transfer housing 18 to air outlet conduit 24. By way of example and not limitation sleeves 112 and 114 could be one tubular member extending through heat transfer housing 18. Another possible embodiment of such an isolating means includes one or more tubes providing a fluid connection from air intake conduit 22 through heat transfer housing 18 to air outlet conduit 24, wherein the tubes comprise multiple vertical or horizontal dividers to maximize the length of the pathway through heat transfer housing 18, and to maximize the surface area of the tubes in contact with the air flowing there through.

In one embodiment illustrated in FIGS. 5 and 7, the ends of each heat transfer tube 120 are optionally outwardly flared after insertion in the opposing pair of openings 116 formed in housing portion 108 to secure each heat transfer tube 120 in the desired location and to facilitate the flow of air through heat transfer tubes 120. The diameter of each heat transfer tube 120 is such that the fit between the outer diameter of the tube and the perimeter of the corresponding openings 116 are relatively tight, so as to prevent the harmful exhaust gases from contaminating the air being heated. Further, heat transfer tubes 120 can be welded or otherwise bonded within openings 116 to prevent passage of exhaust gases. One skilled in the art will appreciate that heat transfer tubes 120 may have other shapes and sizes that are suitable for the intended use of air heating system 10.

As illustrated in FIG. 7, burner 52 is located within heat transfer chamber 110, defined by housing portion 108, and is proximate to heat transfer tubes 120. A burner access hole 124 (see FIG. 4) is defined on either or both front or back side 108A or 108B of housing portion 108 for allowing a user to insert a match to light burner 52 to initiate operation of heating system 10. Alternatively, one skilled in the art will appreciate that other configurations for lighting burner 52 could be employed with air heating system 10 in accordance with its intended use. Examples of such other configurations include electric or piezo-electric spark igniters or automatic lighting devices.

As shown in FIG. 7, multiple heat deflectors 126 are located inside heat transfer housing 18. In one embodiment, two heat deflectors 126 are utilized. In another embodiment, two or more heat deflectors 126 are used. In this embodiment, a heat deflector 126 is positioned to concentrate or direct the heat as well as to serve as an insulator for sidewalls walls of housing portion 108. It will be appreciated that various other numbers of heat deflectors 126 may be used to carry out the function thereof. Heat deflectors 126 include a first end 127 connected to the inner surfaces of front and back sides 108A and 108B, respectively, of housing portion 108. Heat deflectors 126 are configured to narrow heat transfer chamber 110 in a direction from burner 52 toward heat transfer tubes 120, thereby concentrating or directing the heat produced by burner 52 to an area proximate heat transfer tubes 120. In one embodiment, heat deflectors 126 are composed of spring steel, but it will be appreciated that heat deflectors 126 could be constructed from various other suitable materials known in the art.

In addition to directing the heat toward heat transfer tubes 120, heat deflectors 126 also serve as a heat insulator that prevents at least a portion of the heat produced by burner 52 from reaching front and rear sides 108A and 108B of housing portion 108, respectively, thereby keeping the surface of housing portion 108 cooler during operation of air heating system 10 than would be possible without heat deflectors 126. Heat deflectors 126 thereby increase the safety of the air heating system 10 device by reflecting the heat produced by burner 52 away from housing portion 108 so that housing portion 108 is not the primary point of heat contact.

Turning now to FIG. 8, illustrated is a portable air heating system 10 in partial cutaway view and set up in another possible configuration for use in conjunction with tent 12. When in operation, air heating system 10 produces a continuous supply of heated air to tent 12 in the manner described below. Desirably, the air heated by air heating system 10 is free of significant concentrations of harmful and potentially dangerous exhaust gases, and is therefore suitable for use in enclosed structures, such as tent 12.

The following discussion relates to operation of air heating system 10. It will be appreciated that while the discussion is referencing FIG. 8, it is also generally applicable to FIG. 1 and the overall operation of air heating system 10. As shown in FIG. 8, connector 56 of portable air heating system 10 is connected to (typically by inter-engaging threads) the top of fuel source 58. Needle 60 (FIGS. 4-7) of connector 56 is, by this arrangement, disposed a short distance within fuel source 58 to enable a flow of fuel to be initiated when operation of portable air heating system 10 is begun. Fuel source 58 is preferably fitted with a base 58A for providing stability to fuel source 58. Thus, air heating system 10 is disposed stably in a vertical orientation a short distance above the ground.

As seen from FIG. 8, air intake conduit 22 is removably connected at its second end 22B to heat transfer housing 18. In this particular arrangement or usage of portable air heating system 10, first end 22A of air intake conduit 22 is disposed inside tent 12, while second end 22B removably connects to one of sleeve 112 and 114 (FIG. 6). Second end 24B of air outlet conduit 24 is removably connected to heat transfer housing 18, while first end 24A thereof is also disposed within tent 12. In some circumstances, this configuration of the air conduits 22 and 24 is desirable if maximum heating of tent 12 is desired. Alternatively, end 22A of air intake conduit 22 may be disposed outside of tent 12 to maximize the amount of fresh, ambient air being introduced to portable air heating system 10, as shown in FIG. 1.

To initiate a flow of heated air to a desired location, a user initially turns on motorized fan 26 by electrically connecting electrical cable leads 26D to an appropriate power source, for example, to a 12-volt car battery 130 via clamps 26E as illustrated in FIG. 8. Alternative power sources include, by way of example and not by limitation, a rechargeable battery pack, a generator, or various other sizes of batteries, such as a 6-volt battery. The operation of motorized fan 26 draws a flow of air into first end 22A of air intake conduit 22, through a sleeve (not shown), and into heat transfer tubes 120 in heat transfer housing 18. The air then exits heat transfer housing 18 via a sleeve (not shown) and passes through air outlet conduit 24, exiting at first end 24A thereof and into tent 12.

Once motorized fan 26 is turned on, the user ignites the fuel at burner 52 by opening fuel valve 62 (FIG. 6) of connector 56 via knob 62A. The opening of valve 62 causes fuel from fuel source 58 to pass through needle 60 (not shown) and into fuel burner assembly 16 where it is mixed with air. A match or similar flame source is then introduced at burner 52 through burner access hole 124 to ignite the fuel. Lighting the fuel begins a sustained combustion at the surface of burner 52 and creates a large quantity of heat that is transmitted via radiation and convection in a generally upward direction. The heat can be concentrated by heat deflectors 126 (not shown) toward heat transfer tubes 120, which are arranged in one embodiment to maximize heat transfer from the combustion to the heat transfer tubes 120.

Heat transfer tubes 120, comprising a thermally conductive material such as by way of example and not limitation, copper or stainless steel, readily absorb the radiated heat and transmit the heat to the air flowing there through. The heated air continuously flows into tent 12 via air outlet conduit 24, thereby heating the interior of tent 12. If portable air heating system 10 is used according to the configuration shown in FIG. 8, warm air existing in tent 12 is then recirculated into portable air heating system 10 via air intake conduit 22 and heated again before flowing back into tent 12. In this way, air heating system 10 is able to take advantage of previously heated air in tent 12, thereby providing even more warmth for the user.

Alternatively, first end 22A of intake conduit 22 may be disposed exterior to tent 12 as illustrated in FIG. 1, taking care not to place it near heat transfer housing 100 where harmful exhaust gases may be present, to introduce ambient outside air into air heating system 10. The user may also vary the rate of combustion at burner 52, and hence the rate at which air heating system 10 heats air, by varying the flow of fuel through valve 62 (FIG. 6) via an adjustment to knob 62A. It will be appreciated that an optional speed control may be added to motorized fan 26 to control the flow of air flowing through air heating system 10.

After transmitting a significant portion of its heat to heat transfer tubes 120, the remaining heat and exhaust gases produced by burner 52 continue to rise past heat transfer tubes 120 to top surface 102A. This remaining heat and exhaust gases heat top surface 102A, and then safely exit into the atmosphere via openings 102C in top surface 102A or via the vent openings 102C disposed on sides 102B of first end portion 102. Heated top surface 102A may be used as a heating surface for such things as food or water placed in a container 132. Portable air heating system 10 can be used in adverse weather without the rain or snow from gaining access to the burner because of the configuration of heat transfer housing 100 and particularly surface 102A. Further, because the exhaust gases produced by burner 52 are isolated from air transfer assembly 20 during operation of portable air heating system 10, the heated air flowing through air transfer assembly 20 is free from contamination by the harmful exhaust gases.

In addition to heating an enclosed structure such as a tent, portable air heating system 10 may also be used as a body warmer by directing the flow of heated air from air outlet conduit 24 directly onto a person. It is also understood that burner 52 may be turned off by the user at any time during operation of portable air heating system 10, thereby allowing unheated air to flow through the air transfer assembly 20 and into tent 12.

Figure 9:
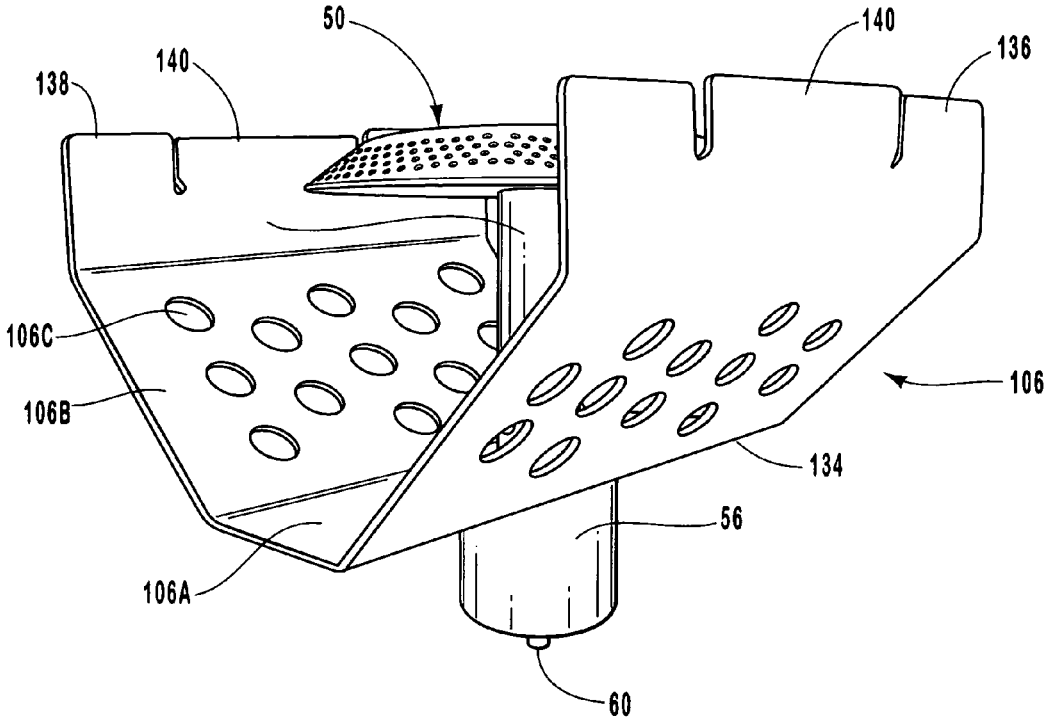
FIG. 9 is a perspective view of another possible embodiment of a burner assembly.

It is appreciated that the details of various features of portable air heating system 10 could be varied while still preserving the same functionality. For example, in an alternative embodiment of portable air heating system 10, second end portion 106 of heat transfer housing 18 is not fixedly attached to middle portion 104 as shown in FIG. 7, but rather removably attached thereto. An example of such a second end portion 106 is shown in FIG. 9. As can be seen, each angled segment 106B of second end portion 106 includes a first end 134 adjacent substantially planar segment 106A, and a second end 136 for attachment to middle portion 104 of the housing 18 (FIG. 7). Second end 136 of angled segment 106B includes a vertical portion 138 having a segment that forms a notched clip 140 for frictionally engaging the end of middle portion 104 when middle portion 104 (FIG. 7) and second end portion 106 are joined together. Alternatively, notched clip 140 could be disposed on the end of middle portion 104.

The removability feature of second end portion 106 of heat transfer housing 100 provides expanded utility to portable air heating system 10. For instance, removable second end portion 106 may be separated from air heating system 10 and joined to other components to form a portable stove unit for cooking, or to a portable shower unit to function as a water heater.

Turning now to FIGS. 10-14, illustrated is another alternate embodiment of a portable air heating system of the present invention. Air heating system 200 includes many of the features and functions of the other air heating systems described herein and so the previous discussions also apply to air heating system 200. The inventive portable heating system provides a reliable source of heated air to an enclosed structure, such as a tent, tent trailer, camper or camper trailer, shelter, storage facility, vehicle, or other structure used by individuals, animals, or equipment, whether or not such structure is fixed or movable. The portable heating system provides the source of heated air while eliminating the introduction of potentially dangerous exhaust gases, such as carbon monoxide, into the enclosed structure. In addition, the air heating system is portable and simple to use, which is particularly important when the user is traveling to remote areas.

Air heating system 200 can be used in a more commercial or industrial settings where large temperature differences exist between the ambient air temperature and the desired air temperature within a temporary or permanent structure and/or the temporary or permanent structure has a large interior volume. Air heating system 200 is also useful where large quantities of warm air are needed, such as, in military, disaster or hazardous waste clean-up, fire, hospital, decontamination, and other similar settings.

Figure 10:
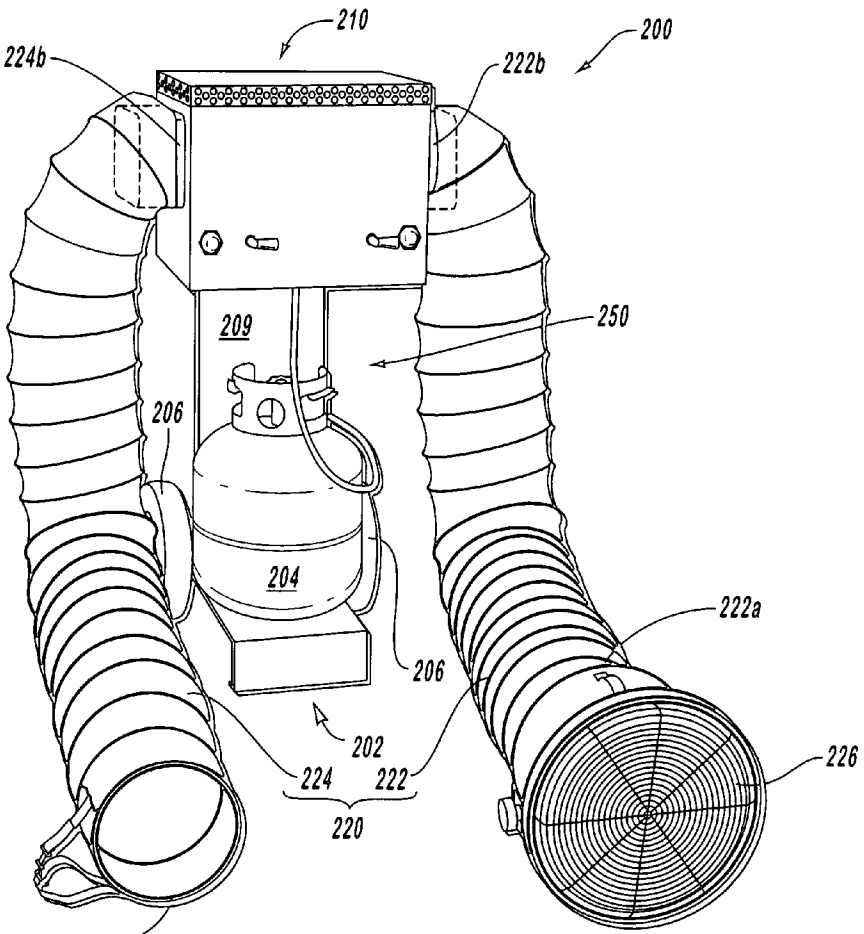
FIG. 10 is a perspective view of another possible embodiment of the portable air heating system of the present invention.

As illustrated in FIG. 10, portable air heating system 200 includes a heat transfer housing 210, an air transfer assembly 220, and a fuel burner assembly 250. During operation of air heating system 200, the above components operate in unison to provide a safe supply of heated air for use as desired by the user. In one illustrated embodiment, heat transfer housing 210 and hence portions of fuel burner assembly 250 and air transfer assembly 220 are supported by optional support frame 202. As depicted, support frame 202 also supports a fuel source 204 and provides a structure that is easily mobile. In this configuration, optional support frame 202 has a lower portion that supports fuel source 204 and an upper portion (not shown), extending from a rearward portion that mounts to heat transfer housing 210. Other configurations of support frame 202 are known to those skilled in the art. It will be appreciated that support frame 202 could be eliminated without affecting the functionality of heater system 200.

Mounted to support frame 202 are wheels 206. These wheels 206 facilitate easy mobility for air heating system 200. Although reference is made to wheels 206, one skilled in the art will understand that alternative embodiments of air heating system 200 can optionally be disposed on skis, sleds, tracks, or other structures that aid in making air heating system 200 mobile. Various alternate configurations would be understood by those skilled in the art in light of the teaching contained herein.

With continued reference to FIG. 10, air transfer assembly 220 can have a similar configuration to air transfer assembly 14 (FIG. 1). As such, an air intake conduit 222 has open first and second end 222*a* and 222*b*, respectively, and air outlet conduit 224 has open first and second ends 224*a* and 224*b*, respectively. Second ends 222*b* and 224*b* of air intake 222 and air outlet conduit 224, respectively, are removably attached to heat transfer housing 210 to direct a flow of air through heat transfer housing 210. The particular configuration of air intake conduit 222 and air outlet conduit 224 can be similar to air intake and air outlet conduits 22 and 24. For instance, conduits 222 and 224 can be flexible to offer maximum versatility in positioning conduits 222 and 224 in the desired locations relative to the structure being heated and the heat transfer housing 210.

In one possible configuration, first end 222*a* of air intake conduit 222 can accommodate a motorized fan 226 that aids in directing air towards heat transfer housing 210. The motorized fan 226 can have similar configurations to and functions as fan 26 (FIG. 2). This fan 226 can be mounted to an exterior surface of air intake conduit 222 or alternatively can be disposed within a lumen (not shown) of air intake conduit 222. In other configurations, fan 226 can accommodate both an exterior surface and interior surface of air intake conduit 222. The fan 226 can be any blower type fan, such as, but not limited to, a ram fan or other blower. One skilled in the art will appreciate the various types of fans can be used to blow or draw air into air intake conduit 222.

Motorized fan 226 can be configured to include a power source (not shown). It will be appreciated that various types of power sources could be utilized for motorized fan 226, such as batteries or adaptors to connect motorized fan 226 to a separate power source such as a car battery, generator, or other power source. Although not shown in FIG. 10, motorized fan 226 can include one or more electrical cable leads that are in electrical communication with motor. These electrical cable leads may have any suitable length, such as by way of example and not limitation, approximately twelve feet, and can be fitted with clamps to allow motorized fan 226 to be electrically connected to a car battery or other power source. Motorized fan 226 may also include an on/off switch (not shown) to control the function of the fan during operation of air heating system 200.

In another embodiment, the electrical cable leads may be electrically connected to a twelve volt cigarette plug configured to cooperate with a car, boat, camper and the like. Alternatively, the electrical cable leads may be attached to a rechargeable battery or other suitable power source disposed near heating system 200 for added convenience and portability.

Cooperating with air transfer assembly 220 is heat transfer housing 210. Heat transfer housing 210 functions in a similar manner to heat transfer housing 18 (FIG. 1). The heat transfer housing 210 facilitates the transfer of heat generated by one or more burners to the air passing through air transfer assembly 220. The heat transfer housing 210 also directs combustion products and harmful exhausts gases away from the location where air transfer assembly 220 collects air to be directed into the structure to be heated or the person to be heated. In this manner, heat transfer housing 210 aids in isolating the air heated by air heating system 200 from the combustion portion of air heating system 200 producing the heat.

Figure 11:
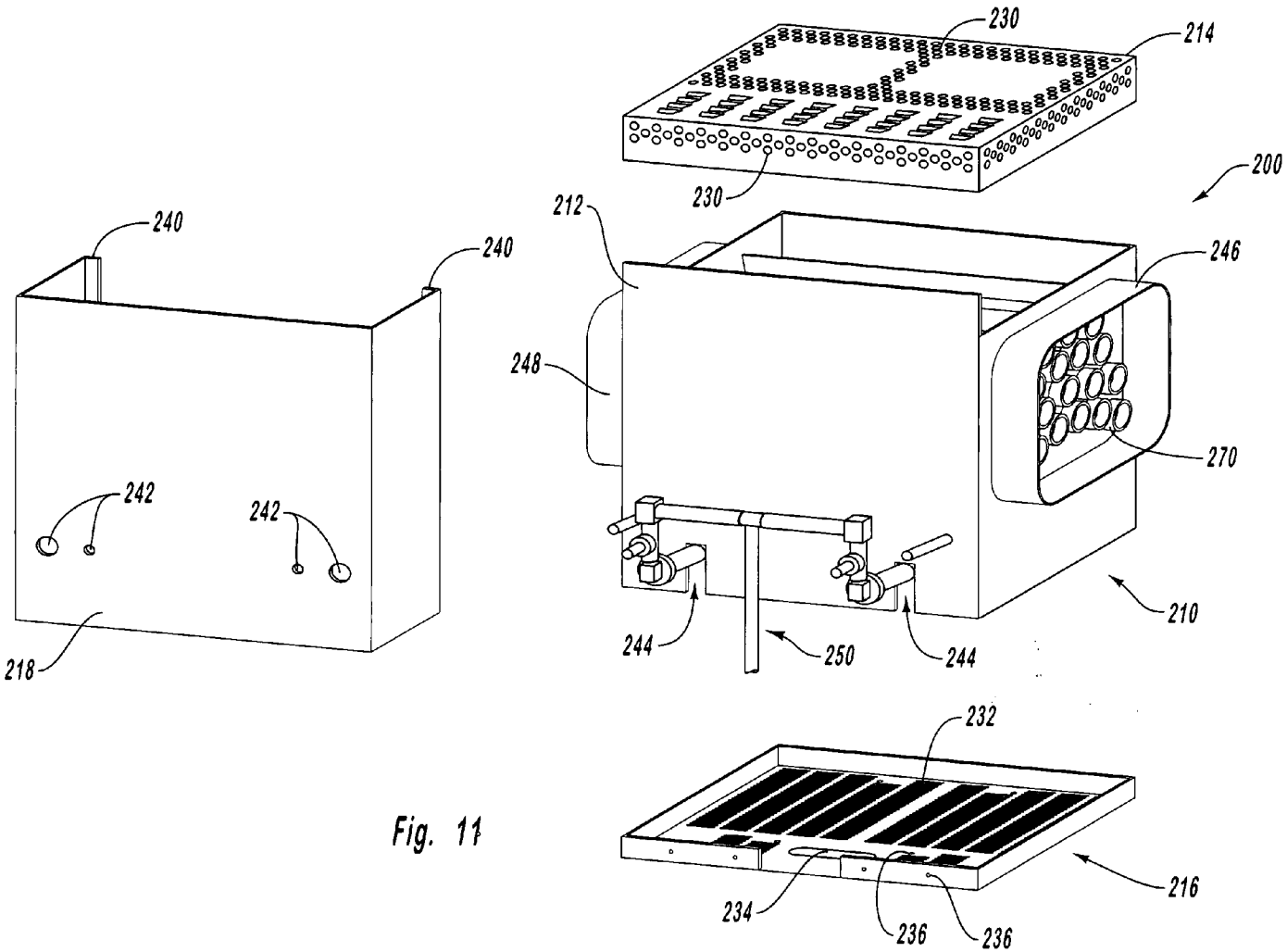
FIG. 11 is a partially exploded perspective view of the heat transfer housing of the portable air heating system shown in FIG. 10.

As shown in FIG. 11, heat transfer housing 210 can include a main body 212 to which mounts a top 214, a base 216, and a front panel 218. Top 214 can have a similar configuration to first end portion 102 (FIG. 4) of heat transfer housing 18. Therefore, top 214 can include a plurality of openings 230 in the upper portion and side portions of top 214. These openings 230 serve to vent exhaust gases from heat transfer housing 210 during use of air heating system 200.

Similarly, base 216 includes a plurality of openings 232 that provide an inlet path for combustion gases. For instance, as fuel burner assembly 250 creates the heat necessary to heat air passing through heat transfer housing 210, air can be drawn into heat transfer housing through openings 232. In addition to openings 232, base 216 includes a hole 234 that accommodates a portion of fuel burning assembly 250 and one or more holes 236 that can receive one or more fasteners (not shown) to attach heat transfer housing 210 to support frame 202 and/or base 216 to main body 212. Other methods of attachment are known to attach heat transfer housing 210 to support frame 202, such as, but not limited to, welds, other mechanical fasteners, or other structures that allow heat transfer housing 210 to be permanently or releasably connected to support frame 202.

Front panel 218 can mount to main body 202. Front panel 218 has a generally "C" shaped configuration having flanges 240 that mount to main body 212. A number of holes 242 in front panel 218 provide access to portions of fuel burner assembly 250. The front panel 218 aids to separate a user from main body 212 and prevent inadvertent contact with main body 212 during use.

The main body 212 has a front portion, a rear portion, and side portions. The front portion includes two channels 244 that enable a portion of fuel burner assembly 250 to extend there through to cooperate with holes 242 of front panel 218. The size and configuration of channels 244 can vary based upon the particular configuration of fuel burner assembly 250, such as, but not limited to, the number of burners, ignition devices, connectors, valves, etc.

The front portion, rear portion, and side portions of main body 212 define an interior enclosure for burning fuel and transferring heat to the air flowing through air transfer assembly 220. Main body 212 can include an air intake sleeve 246 mounted to one side portion and an air outlet sleeve 248 mounted to the other side portion, in a similar configuration to the embodiment illustrated in FIG. 4. Sleeves 246 and 248 can, therefore, have a similar configuration to sleeves 112 and 114. In this manner, sleeve 246 can cooperate with air intake conduit 222 (FIG. 10) and sleeve 248 can cooperate with air outlet conduit 224 (FIG. 10). The conduits 222 and 224 can slip fit or interference fit with respective sleeves 246 and 248. Optionally, mechanical fasteners can be used either alone or in combination with a slip fit or interference fit to connect conduits 222 and 224 with sleeves 246 and 248. More generally, any mechanism or method attachment known to those skilled in the art can be used connect conduits 222 and 224 with sleeves 246 and 248, whether permanently or releasably.

In some cases, a slight deformation of second ends 222*b* and 224*b* (FIG. 10) of air intake and air outlet conduits 222 and 224 may be necessary to accomplish the coupling with the intake and outlet sleeves 246 and 248. Such a deformation is easily accomplished due to the flexible nature of the air intake and air outlet conduits 222 and 224. It will be appreciated that while in the embodiment of air heating system 200 that is depicted air intake conduit 222 and intake sleeve 246 and air outlet conduit 224 and outlet sleeve 248 have slightly different configurations (cylindrical as compared to elliptical) these elements could have various other configurations that are designed to cooperate.

Generally, sleeves 246 and 248 can be hollow members composed of steel, aluminum, metal, or other suitable material. Sleeves 246 and 248 can have various configurations so long as they cooperate with air inlet conduit 222 and air outlet conduit 224 respectively. Consequently, sleeves 246 and 248 can be round, cylindrical, oval, square, rectangular, polygonal, and parabolic, combinations thereof, or other configuration that are complementary to the configuration of air intake conduit 222 and air outlet conduit 224.

Figure 12:
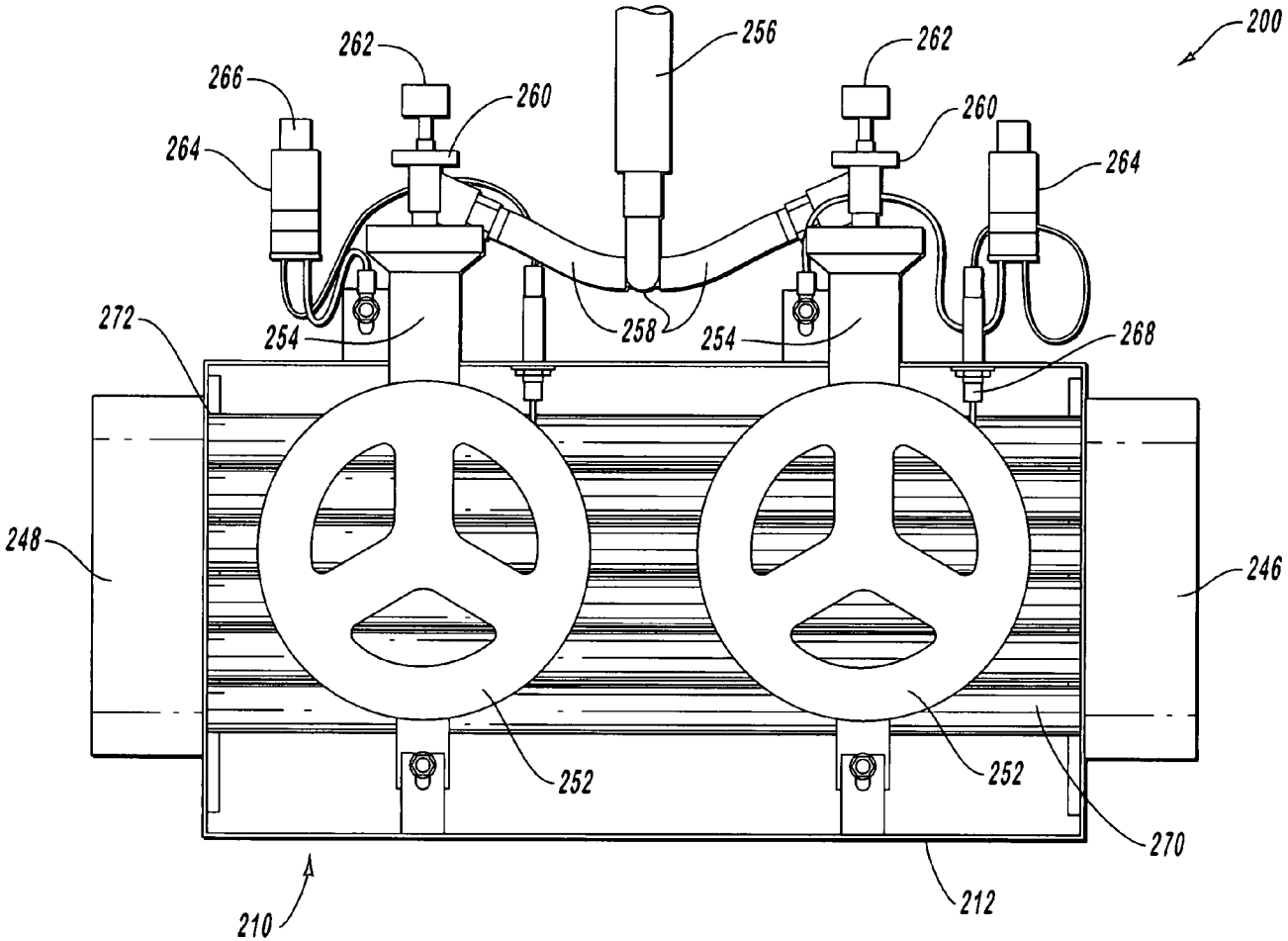
FIG. 12 is a bottom view of a portion of the heat transfer housing of the portable air heating system shown in FIG. 10.

As mentioned above, main body 212 provides a structural support for portions of the fuel burner assembly 250. Fuel burner assembly 250, as shown in FIG. 12, has a similar configuration to fuel burner assembly 16 and includes two or more burners 252. Each burner 252 has an inlet 254 with a generally horizontal longitudinal axis when mounted to main body 212. This results in fuel being delivered to burners 252 in a generally horizontal manner, in contrast to the configuration of FIG. 1, where the inlet of burner 52 has a generally vertical longitudinal axis. It will be understood by those skilled in the art that burners 252 can alternatively have inlets that have longitudinal axes that are generally vertical, diagonal, or at some angular orientation relative to mounting of the burner to main body 212.

The burners 252 can be 35,000 BTU burners and fabricated from cast-iron or other material capable of withstanding the elevated temperatures. Although reference is made to 35,000 BTU burners, one skilled in the art will understand that burners 252 can be rated more or less than 35,000 BTU. Additionally, although only two burners are shown, one can understand that air heating system 200 can include various numbers of burners.

To supply burners 252 with fuel from fuel source 204 (FIG. 10), fuel burner assembly 250 includes fuel supply tube 256, one or more connectors 258, and one or more control valves 260. Fuel supply tube 256 attaches to connectors 258 at one end and fuel source 204 (FIG. 10), such as a conventional propane tank connector at the other end so that fuel burner assembly 250 cooperates with fuel source 204 (FIG. 10). The connectors 258 can include any type of member that directs the flow of fuel from fuel source 204, including but not limited to, tubular members, conduit, brackets, metal connectors, or the like. Valves 260 control the flow of fuel from fuel source 204 (FIG. 10) and control the flow of fuel to burners 252. These valves 260 can include control knobs 262 attached thereto to enable a user to open and close valves 260.

Cooperating with burners 252 are two optional ignition devices 264. In the exemplary configuration, ignition devices 264 are electric or piezo-electric spark igniters or automatic lighting devices. By manipulating a button 266 of ignition device 264, a spark is created at an electrode 268 that ignites fuel flowing through supply tube 256, connectors 258, and valves 260 to produce the desired heating. It will be understood that rather than having optional ignition devices 264 a user can manually ignite fuel exiting from burners 252.

As shown in FIGS. 11 and 12, the configuration of air heating system 200 includes an isolating means for isolating the air being heated from the exhaust gases produced by the fuel combustion in the system. The isolating means includes a structure providing a conduit between air intake sleeve 246 to air outlet sleeve 248. One example of a structure capable of performing the function of isolating the air being heated from the exhaust gases is heat transfer housing 210 that supports one or more heat transfer tubes or members 270. In other configuration, the structure can be the heat transfer tubes or members 270 alone.

As illustrated in FIG. 12, these heat transfer tubes 270 extend between the sides of main body 212 and may extend within sleeves 246 and 248. Each heat transfer tube 270 absorbs heat emitted by burner 252 during combustion of the fuel, transferring the heat to air flowing through heat transfer tubes 270. The heat transfer tubes 270 can be considered as part of air transfer assembly 220, heat transfer housing 210, and/or the means for isolating the air being heated from the exhaust gases produced by the fuel combustion in the system.

Each heat transfer tube 270 absorbs heat emitted by burner 252 during combustion of the fuel, transferring the heat to air flowing through heat transfer tubes 270. In one embodiment, heat transfer tubes 270 are composed of copper, metals, or other conductive material. It will be appreciated that heat transfer tubes 270 could be composed of other materials that are capable of absorbing the heat emitted by burner 252 and transferring the same to the air flowing through heat transfer tube 270.

It will be appreciated that various lengths of heat transfer tubes 270 may be used as long as each heat transfer tube 270 is configured to cooperate with heat transfer housing 210, and isolates the air being heated from the harmful exhaust gases. It will be appreciated that although each heat transfer tube 270 is illustrated as being a hollow round member, each heat transfer tube 270 could have various other shapes or configurations as long as it is hollow. By way of example and not limitation, each heat transfer tube 270 could be oval, elliptical, square, rectangular, polygonal, or the like and any combination thereof as long as it is a hollow member.

Although heat transfer tube or member 270, whether alone or in combination with the other portions of heat transfer housing 210, is one example of an isolating means, another possible embodiment of an isolating means for isolating the air being heated from the exhaust gas is a single tubular member (not depicted) providing a fluid connection from air intake sleeve 246 through heat transfer housing 210 to air outlet sleeve 248. By way of example and not limitation, sleeves 246 and 248 could be one tubular member extending through heat transfer housing 210. Yet another possible embodiment of such an isolating means includes one or more tubes providing a fluid connection from air intake conduit 222 through heat transfer housing 210 to air outlet conduit 224, wherein the tubes have multiple vertical or horizontal dividers to maximize the length of the pathway through heat transfer housing 210, and to maximize the surface area of the tubes in contact with the air flowing there through.

Figure 13:
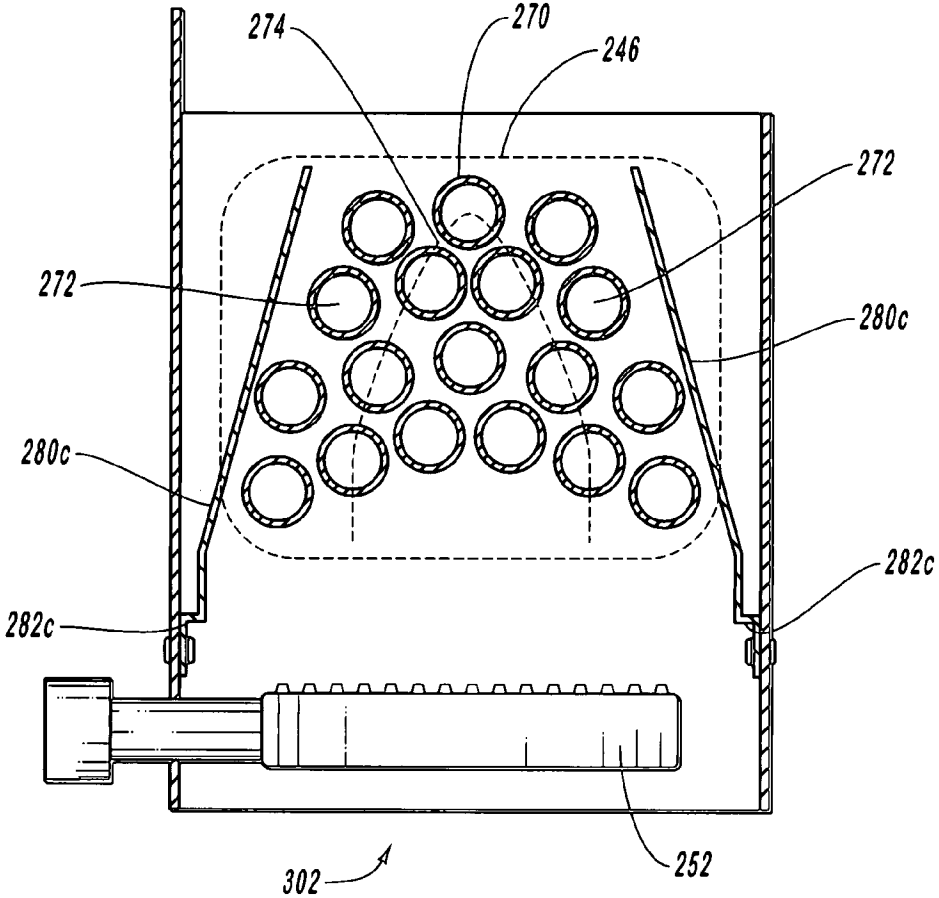
FIG. 13 is a cross sectional side view of the heat transfer housing of the portable air heating system shown in FIG. 10.

To aid with positioning heat transfer tubes 270, each side portion of main body 212 includes a plurality of openings 272, which are shown in FIG. 13 with heat transfer tubes 270 disposed therein. While only one side of main body 212 is depicted in FIG. 13, it will be appreciated that the opposite side of main body 212 is substantially identical and has an identical number of opening 272. These openings 272 have a similar purpose and configuration to openings 116 (FIG. 5), which is to receive a portion of a heat transfer tube 270. With openings 272 arranged in pairs on opposing sides of main body 212, heat transfer tubes 270 can be fixable attached to heat transfer housing 201 such as with welds, adhesives, friction fits, combinations thereof, or other manner for securely mounting a heat transfer tube within a pair of openings. Optionally, the ends of heat transfer tubes 270 can be flared to aid with attaching the same to heat transfer housing 270.

In the illustrated configuration, openings 272 are in an arc-like formation indicated by line 274. Other openings 272 are positioned around this arc-like arrangement to maximize heat transfer from the combustion to the heat transfer tubes 270. In this configuration, heated air passes by one or more of heat transfer tubes 270, thereby heating heat transfer tubes 270 and transferring the generated heat to heat transfer tubes 270. It will be understood that opening 272 can be formed in any configuration and need not be formed in the arc-like arrangement. For instance, openings 272 can be arranged in horizontal columns or vertical rows. Additionally, openings 272 can be arranged in diagonal lines, circular or curved patterns or configurations, or any other configuration that allows heat to be transferred to transfer tubes 270. Various orientations and numbers of openings 272, and consequently heat transfer tubes 270, are possible.

Figure 14:
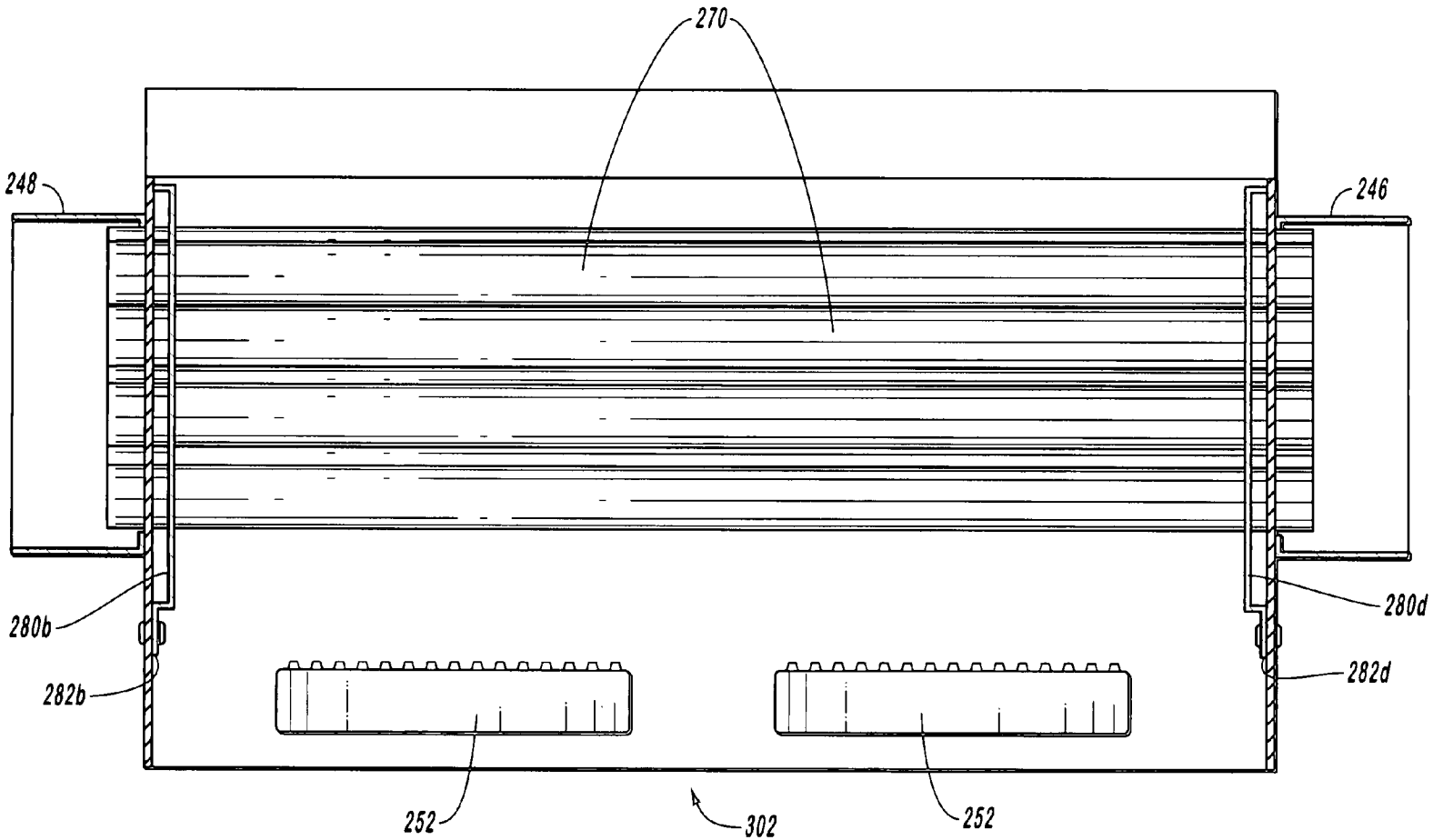
FIG. 14 is a cross sectional view of the heat transfer housing of the portable air heating system shown in FIG. 10.

Also disposed within the interior of heat transfer housing 210 are multiple optional heat deflectors 280. As depicted in FIGS. 13 and 14, these optional one or more of heat deflectors 280 can have a similar configuration to heat deflectors 126 discussed with respect to FIG. 7. FIGS. 13 and 14 depict four optional heat deflectors 280*a*-280*d*; however, other embodiments can include one or more deflectors or no deflectors. The optional heat deflectors 280*a* and 280*c* primarily concentrate or direct the heat toward heat transfer tubes or members 270, while deflectors 280*b* and 280*d* primarily insulate the side portions of main body 212. Secondarily, heat deflectors 280*a* and 280*c* insulate the front and rear portions of main body 212, while deflectors 280*b* and 280*d* concentrate or direct the heat toward the heat transfer tubes or members 270. Deflectors 280*a*-280*d* can also provide added structural support to main body 212 and support to heat transfer tubes or members 270.

By directing the heat generated by burners 252 toward heat transfer tubes 270 and preventing at least a portion of the heat produced by burner 252 from reaching the front, rear, and side portions of main body 212, optional deflectors 280*a*-280*d* keep the surface of main body 212 cooler during operation of air heating system 200 than would be possible without the inclusion of heat deflectors 280*a*-280*d*. Heat deflectors 280*a*-280*d* thereby increase the safety of the air heating system 200 device by reflecting the heat produced by burners 252 away from main body 212 of heat transfer housing 210 so that heat transfer housing 210 is not the primary point of heat contact. It will be understood by one skilled in the art that air heating system 200 can perform the function of heating air without the inclusion of optional heat deflectors 280*a*-280*d*.

A first end 282*a*-282*d* of each deflector 280*a*-280*d* is connected to the inner surfaces of main body 212. Deflectors 280*a* and 280*c* are configured to narrow heat transfer housing 210 in a direction from burners 252 toward heat transfer tubes 320, thereby concentrating or directing the heat produced by burners 252 to an area proximate heat transfer tubes 270. In one embodiment, the heat deflectors are composed of spring steel, but it will be appreciated that the heat deflectors could be constructed from various other suitable materials known in the art. With the heat transfer tubes 270 in the arc-like configuration, the heat produced by burners 252 can efficiently transferred to one or more of heat transfer tubes 270. The heated air can be directed to one or more of heat transfer tubes 270, with the highest density of heat transfer tubes 270 being within the middle of the space defined by deflectors 280*a*-280*d*. This arc-like arrangement maximizes heat transfer from the combustion to the heat transfer tubes 270.

The operation of air heating system 200 depicted in FIGS. 10-14 is similar to that of air heating system 10 described with respect to FIGS. 1-9. A fuel burner assembly 250 is connected to a fuel source 204 by way of various connectors. The valves 260 of the fuel burner assembly 250 prevent flow of fuel to the burners 252 until they are opened through moving one or more control knobs 262. Before opening the valves 262, the air intake conduit 222 and the air outlet conduit 224 are mounted to inlet sleeve 246 and outlet sleeve 248 of the main body 212 with the free ends of the conduits 222*a* and 224*a* positioned in the desired positions. By way of example and not limitation, desired positions could be placing both free ends of both conduits within the structure to be heated or placing the free end of the intake conduit 222*a* outside the structure and the free end of the outlet conduit 224*a* within the structure. Also before opening the valves 260, the motorized fan 226 is connected to an appropriate power source, such as a battery or generator, using electrical cables and connectors.

When the fan 226 is operating to draw air into the free end of the intake conduit 222*a* and through the heat transfer tubes 270, the user can open the valves 260 and ignite the burners 252 by turning the control knobs 262 and manually lighting or by manipulating the optional piezo-electric spark igniters of the ignition devices 264. Lighting the fuel begins a sustained combustion at the surface of the burners 252 and creates a large quantity of heat that is transmitted via radiation and convection in a generally upward direction. The heat is concentrated by the heat deflectors 280*a*-280*d* toward the heat transfer tubes 270, which are arranged in one embodiment to maximize heat transfer from the combustion to the heat transfer tubes 270.

Heat transfer tubes 270, having a thermally conductive material such as, by way of example and not limitation, copper or stainless steel, readily absorb the radiated heat and transmit the heat to the air flowing there through. The heated air continuously flows into the structure via the air outlet conduit 224, thereby heating the interior of the structure.

idler transmitting a significant portion of its heat to the heat transfer tubes 270, the remaining heat and exhaust gases produced by the burners 252 continue to raise past heat the transfer tubes 270 to the top 214 of the heat transfer housing 210. This remaining heat and exhaust gases heat the top 214 of the heat transfer housing 210, and then safely exit into the atmosphere via the openings 230 formed therein. The heated top 214 may be used as a heating surface for such things as food or water placed in a container (not shown). The portable air heating system 200 can be used in adverse weather without the rain or snow from gaining access to the burners 252 because of the configuration of the heat transfer housing 210. Further, because the exhaust gases produced by the burners 252 are isolated from the air transfer assembly 220 during operation of the portable air heating system 200, the heated air flowing through the air transfer assembly 220 is free from contamination by the harmful exhaust gases.

As with the other air heating systems described herein, generally, the air heating system 200 of the present invention can be used to provide heated air that can be directed to a structure, a vehicle, a human or animal body, or other location where heated air is desired. Generally, the air heating system can heat air received externally to a structure and then supply the interior of the structure with this heated air. Alternatively, the air heating system can heat or reheat air within the interior of a structure by drawing the air within the structure through the heat transfer tubes and returning the heated or reheated air back into the interior of the structure. The air heating system 200, therefore, produces a continuous supply of heated air to a structure. Desirably, the air heated by air heating system 200 is free of significant concentrations of harmful and potentially dangerous exhaust gases, and is therefore suitable for use in enclosed structures.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A portable air heating system for heating an enclosed area without venting exhaust fumes into the enclosed area, so as to prevent the introduction of dangerous gases into the enclosed area, the portable air heating system comprising:

at least one fuel burner configured to produce heat and exhaust fumes as fuel is burned;

an air transfer assembly including an air intake conduit drawing air in from a location remote from the exhaust gases produced by said fuel burner and an air outlet conduit releasing the heated air at a desired location;

a heat transfer housing supporting at least one heat transfer tube and said at least one fuel burner, said at least one fuel burner being disposed horizontally within said heat transfer housing, said heat transfer housing having an outside surface defining an exterior surface of the portable heating system, said heat transfer housing defining a path for the exhaust fumes around said at least one heat transfer tube as said at least one heat transfer tube provides a path through said heat transfer housing in which the air flowing therethrough and being heated is isolated from the exhaust fumes produced by said at least one fuel burner, said at least one heat transfer tube being fluidly connected to said air intake conduit and said air outlet conduit, each end of said at least one heat transfer tube extending at least through said outside surface of said heat transfer housing and to said air intake conduit and to said air outlet conduit; and at least one heat deflector connected to said heat transfer housing, said at least one heat deflector being angularly disposed within said heat transfer housing proximate to said at least one heat transfer tube to focus the heat from said at least one fuel burner around said at least one heat transfer tube and away from a portion of said heat transfer housing.

2. The portable air heating system of claim 1, wherein said air transfer assembly comprises a fan connected to an external end of said air intake conduit remote from said heat transfer housing.

3. The portable air heating system of claim 1, wherein said air intake conduit and said air outlet conduit are capable of assuming a collapsed and an extended configuration.

4. The portable air heating system of claim 1, wherein said at least one fuel burner is substantially planar.

5. The portable air heating system of claim 1, wherein said portable air heating system comprises a plurality of fuel burners.

* * * * *